US010059558B2

(12) United States Patent
Suzuki et al.

(10) Patent No.: US 10,059,558 B2
(45) Date of Patent: Aug. 28, 2018

(54) SHEET PROCESSING DEVICE WITH SHEET FOLDING DEVICE TO SET A CREASE POSITION AND IMAGE FORMING SYSTEM

(71) Applicants: Michitaka Suzuki, Kanagawa (JP); Tomohiro Furuhashi, Kanagawa (JP); Tomomichi Hoshino, Kanagawa (JP); Satoshi Saito, Kanagawa (JP); Takahiro Watanabe, Kanagawa (JP); Takao Watanabe, Kanagawa (JP); Yuji Suzuki, Kanagawa (JP)

(72) Inventors: Michitaka Suzuki, Kanagawa (JP); Tomohiro Furuhashi, Kanagawa (JP); Tomomichi Hoshino, Kanagawa (JP); Satoshi Saito, Kanagawa (JP); Takahiro Watanabe, Kanagawa (JP); Takao Watanabe, Kanagawa (JP); Yuji Suzuki, Kanagawa (JP)

(73) Assignee: RICOH COMPANY, LIMITED, Tokyo (JP)

( * ) Notice: Subject to any disclaimer, the term of this patent is extended or adjusted under 35 U.S.C. 154(b) by 22 days.

(21) Appl. No.: 14/841,815

(22) Filed: Sep. 1, 2015

(65) Prior Publication Data

US 2016/0068359 A1 Mar. 10, 2016

(30) Foreign Application Priority Data

Sep. 4, 2014 (JP) ..... 2014-180602

(51) Int. Cl.
*B65H 45/16* (2006.01)
*B65H 45/30* (2006.01)
*B65H 45/14* (2006.01)

(52) U.S. Cl.
CPC ..... *B65H 45/30* (2013.01); *B65H 45/14* (2013.01)

(58) Field of Classification Search
CPC ..... B65H 45/20; B65H 45/147; B65H 45/30; B65H 45/14

(Continued)

(56) References Cited

U.S. PATENT DOCUMENTS 5,769,774 A * 6/1998 Beck ..... B65H 45/148 493/419
6,251,054 B1 * 6/2001 Cruz ..... B42C 1/12 270/32

(Continued)

FOREIGN PATENT DOCUMENTS

JP 2003-267626 A 9/2003
JP 2007-045531 2/2007

(Continued)

OTHER PUBLICATIONS

Office Action for Corresponding Japanese Patent Application No. 2014-180602 dated May 22, 2018.

*Primary Examiner* — Patrick H Mackey
(74) *Attorney, Agent, or Firm* — Harness, Dickey & Pierce, P.L.C.

(57) ABSTRACT

A sheet processing device includes a conveying unit, a presser, an end detector, and a setting unit. The conveying unit conveys a sheet having a crease formed therein. The presser presses the crease in the sheet. The end detector detects an end in a conveying direction of the sheet at a position upstream of the presser in the conveying direction. The setting unit sets a crease position where the crease is to be formed. Upon detection of the end in the conveying direction, the conveying unit conveys the sheet to a position where the crease faces the presser, on the basis of the crease position set by the setting unit. The presser presses the crease in the conveyed sheet.

19 Claims, 35 Drawing Sheets

(58) Field of Classification Search
USPC ..... 270/32, 39.01; 493/416, 434, 419, 435, 493/421, 440, 442
See application file for complete search history.

(56) References Cited

U.S. PATENT DOCUMENTS

| | | | | |
|---|---|---|---|---|
| 6,550,756 | B2 * | 4/2003 | Trovinger | B65H 5/32 270/32 |
| 6,589,000 | B1 * | 7/2003 | Boss | B42C 9/0093 412/18 |
| 6,719,680 | B2 * | 4/2004 | Hosoya | B65H 45/142 493/324 |
| 6,730,010 | B2 * | 5/2004 | Yamakawa | B65H 45/12 493/267 |
| 6,921,069 | B2 | 7/2005 | Suzuki et al. | |
| 6,997,450 | B2 * | 2/2006 | Trovinger | B65H 5/32 270/32 |
| 7,077,393 | B2 * | 7/2006 | Ishida | G03G 15/6544 270/32 |
| 7,137,944 | B2 | 11/2006 | Suzuki et al. | |
| 7,597,311 | B2 * | 10/2009 | Kawata | B65H 45/18 270/12 |
| 7,798,950 | B2 | 9/2010 | Kobayashi et al. | |
| 8,317,179 | B2 * | 11/2012 | Takata | B26F 1/02 270/30.08 |
| 8,490,957 | B2 * | 7/2013 | Nagasako | B31F 1/10 270/32 |
| 9,102,117 | B2 * | 8/2015 | Suzuki | B65H 45/14 |
| 9,221,647 | B2 * | 12/2015 | Furuhashi | B65H 45/04 |
| 9,334,140 | B2 * | 5/2016 | Watanabe | B65H 45/04 |
| 9,388,015 | B2 * | 7/2016 | Suzuki | B65H 45/04 |
| 2003/0151187 | A1 | 8/2003 | Suzuki et al. | |
| 2005/0206071 | A1 | 9/2005 | Suzuki et al. | |
| 2012/0261872 | A1 * | 10/2012 | Kagami | B65H 45/12 270/45 |
| 2014/0141956 | A1 | 5/2014 | Suzuki et al. | |
| 2014/0147184 | A1 | 5/2014 | Kunieda et al. | |
| 2014/0171283 | A1 | 6/2014 | Furuhashi et al. | |
| 2014/0179504 | A1 | 6/2014 | Nakada et al. | |
| 2014/0336031 | A1 | 11/2014 | Suzuki et al. | |
| 2014/0364295 | A1 | 12/2014 | Watanabe et al. | |
| 2015/0031520 | A1 | 1/2015 | Nakada et al. | |
| 2015/0225201 | A1 | 8/2015 | Watanabe | |
| 2015/0266697 | A1 * | 9/2015 | Saito | B65H 45/14 493/421 |
| 2015/0321872 | A1 * | 11/2015 | Hari | B65H 45/30 493/405 |
| 2015/0329309 | A1 * | 11/2015 | Iwata | B41J 11/04 493/409 |
| 2015/0336765 | A1 * | 11/2015 | Sawada | B65H 45/14 493/434 |
| 2016/0060072 | A1 * | 3/2016 | Watanabe | B65H 45/14 493/442 |

FOREIGN PATENT DOCUMENTS

| | | |
|---|---|---|
| JP | 2009-149435 | 7/2009 |
| JP | 2014-101164 | 6/2014 |

* cited by examiner

SHEET PROCESSING DEVICE WITH SHEET FOLDING DEVICE TO SET A CREASE POSITION AND IMAGE FORMING SYSTEM

CROSS-REFERENCE TO RELATED APPLICATIONS

The present application claims priority to and incorporates by reference the entire contents of Japanese Patent Application No. 2014-180602 filed in Japan on Sep. 4, 2014.

BACKGROUND OF THE INVENTION

1. Field of the Invention

The present invention relates generally to a sheet processing device and an image forming system.

2. Description of the Related Art

Image forming apparatuses for producing printouts of digital information and folding devices connected to or mounted inside an image forming apparatus to fold a printout sheet(s) on which an image(s) is formed by the image forming apparatus have become necessary equipment in recent years.

When a sheet is folded by such a folding device, because a crease formed in the sheet is not crisp, the height of the folded sheet will be large. To alleviate this disadvantage, a folding device including an additional folding mechanism that presses a crease to reduce the height of a folded sheet is already proposed and known. Examples of such a folding device are known from Japanese Laid-open Patent Application No. 2007-045531 and Japanese Laid-open Patent Application No. 2009-149435.

However, position of a crease formed in a sheet is not always the same; rather, the position varies depending on a fold type and the size of the sheet. Accordingly, conventional folding devices have a disadvantage that a user is required to set (specify) an additional folding position each time when pressing a crease formed in a sheet so that the crease is pressed adequately. Thus, conventional folding devices disadvantageously cause inconvenience to users.

Therefore, there is a need for a technique for increasing user convenience at causing a crease formed in a sheet to be pressed.

SUMMARY OF THE INVENTION it is an object of the present invention to at least partially solve the problems in the conventional technology.

A sheet processing device includes a conveying unit, a presser, an end detector, and a setting unit. The conveying unit conveys a sheet having a crease formed therein. The presser presses the crease in the sheet. The end detector detects an end in a conveying direction of the sheet at a position upstream of the presser in the conveying direction. The setting unit sets a crease position where the crease is to be formed. Upon detection of the end in the conveying direction, the conveying unit conveys the sheet to a position where the crease faces the presser, on the basis of the crease position set by the setting unit. The presser presses the crease in the conveyed sheet.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of the present invention are described in detail below with reference to the accompanying drawings.

First Embodiment

In a first embodiment, a sheet processing device is implemented as a folding unit connected to or mounted inside an image forming unit to fold a sheet on which an image is formed by the image forming unit. The folding unit according to the first embodiment includes an additional folding mechanism that presses a crease formed by folding a sheet, thereby sharpening the crease and reducing the height of the folded sheet.

Such a folding unit is typically configured to change the position where a crease is to be formed depending on a fold type and a sheet size rather than always forming a crease at a same position. Therefore, in an additional folding, the folding unit will fail to press a crease formed in a sheet accurately when the position of the crease varies from one sheet to another.

To alleviate this disadvantage, a feature of the folding unit according to the first embodiment lies in that a press position for an additional folding is adjusted in accordance with a position of a crease formed in a sheet. This feature allows the folding unit according to the first embodiment to press creases accurately.

Figure 1:
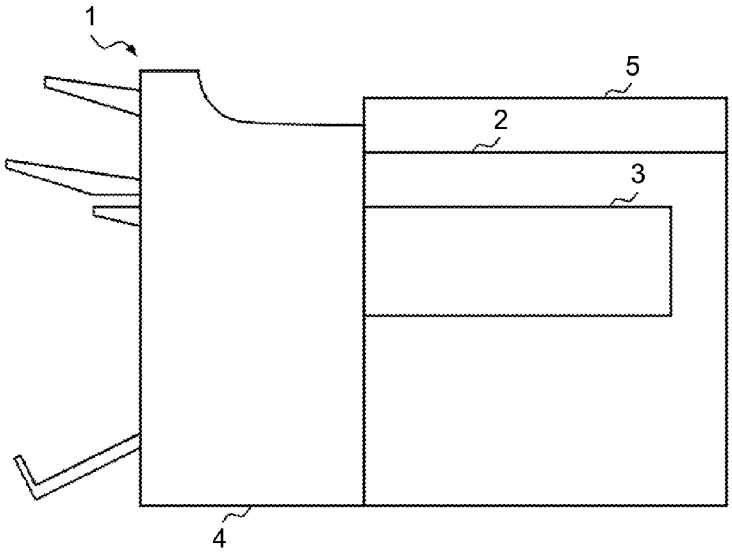
FIG. 1 is a simplified diagram illustrating an overview configuration of an image forming apparatus according to a first embodiment of the present invention.

An overview configuration of an image forming apparatus 1 according to the first embodiment is described below with reference to FIG. 1. FIG. 1 is a simplified diagram illustrating the overview configuration of the image forming apparatus 1 according to the first embodiment. As illustrated in FIG. 1, the image forming apparatus 1 according to the first embodiment includes an image forming unit 2, a folding unit 3, a finisher unit 4, and a scanner unit 5.

The image forming unit 2 generates CMYK (cyan, magenta, yellow, and key plate) print information from input image data, and produces a printout by forming an image on a sheet fed to the image forming unit 2 in accordance with the generated print information. The folding unit 3 performs a folding process and an additional folding process on the image-formed sheet conveyed from the image forming unit 2. Hence, in the first embodiment, the folding unit 3 functions as a sheet processing device and a pressing unit. The finisher unit 4 performs a finishing process such as book binding, stapling, and/or hole punching on a folded sheet(s) conveyed from the folding unit 3.

The scanner unit 5 digitizes an original document (hereinafter, "document") by reading an image of the document with a linear image sensor including a plurality of linearly-arranged photodiodes and a light-receiving device which may be a CCD (charge coupled device) or CMOS (complementary metal oxide semiconductor) image sensor arranged parallel to the photodiodes. The image forming apparatus 1 according to the first embodiment is implemented as a multifunction peripheral (MFP) that has, in addition to these, an image capturing function, an image forming function, a communication function, and the like and therefore is usable as a printer, a facsimile, a scanner, and a copier.

Figure 2:
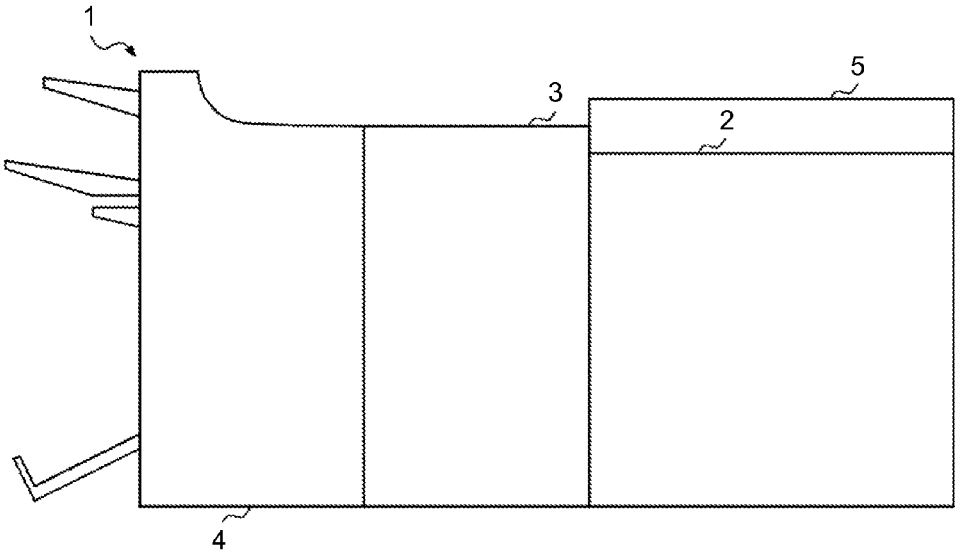
FIG. 2 is a simplified diagram illustrating another overview configuration of the image forming apparatus according to the first embodiment.

Although the image forming apparatus 1 illustrated in FIG. 1 is configured to include the folding unit 3 inside the image forming unit 2, alternatively, the image forming apparatus 1 may be configured to include the folding unit 3 as an independent unit as illustrated in FIG. 2. FIG. 2 is a simplified diagram illustrating an overview of such a configuration of the image forming apparatus 1 according to the first embodiment.

Figure 3:
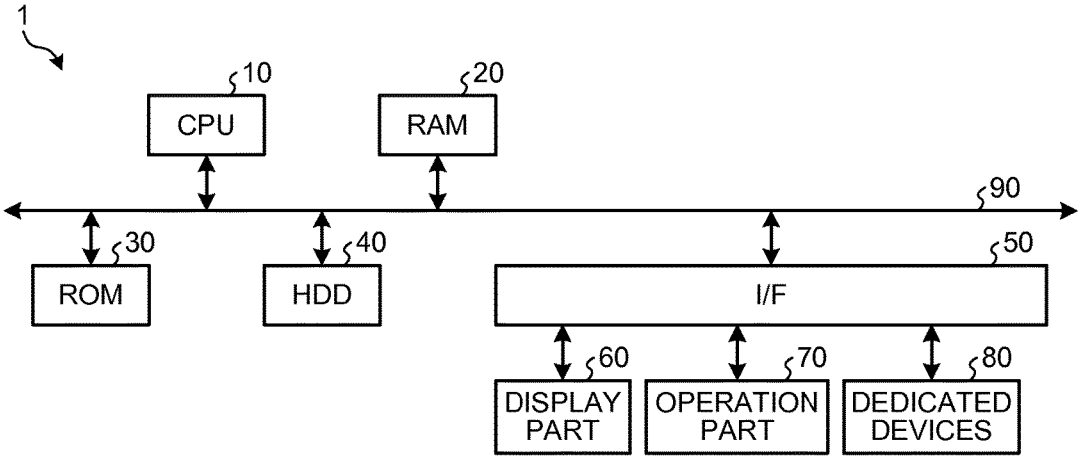
FIG. 3 is a block diagram schematically illustrating a hardware configuration of the image forming apparatus according to the first embodiment.

A hardware configuration of the image forming apparatus 1 according to the first embodiment is described below with reference to FIG. 3. FIG. 3 is a block diagram schematically illustrating the hardware configuration of the image forming apparatus 1 according to the first embodiment.

As illustrated in FIG. 3, the image forming apparatus 1 according to the first embodiment includes elements similar to those of a typical server, a PC (personal computer), or the like. More specifically, the image forming apparatus 1 according to the embodiment includes a CPU (central processing unit) 10, a RAM (random access memory) 20, a ROM (read only memory) 30, an HDD (hard disk drive) 40, and an I/F 50 that are connected to each other via a bus 90. A display part 60, an operation part 70, and dedicated devices 80 are connected to the I/F 50.

The CPU 10 is a processor that controls operations of the entire image forming apparatus 1. The RAM 20 is a volatile storage medium, to and from which information can be written and read out at high speeds, used by the CPU 10 as a working area when processing information. The ROM 30 is a read-only non-volatile storage medium where programs such as firmware are stored. The HDD 40 is a non-volatile storage medium, to and from which information can be written and read out, where an OS (operating system), various control programs, application programs, and the like are stored.

The I/F 50 provides and controls connections between the bus 90 and various hardware, a network, and the like. The display part 60 is a visual user interface that allows a user to check a condition of the image forming apparatus 1 and may be implemented as a display device such as an LCD (liquid crystal display). The operation part 70 is a user interface such as a keyboard and a mouse for use by a user in inputting information to the image forming apparatus 1.

The dedicated devices 80 are hardware, each performing a function(s) dedicated to one of the image forming unit 2, the folding unit 3, the finisher unit 4, and the scanner unit 5. The dedicated device 80 of the image forming unit 2 is a plotter that produces a printout by forming an image on a surface of paper.

The dedicated devices 80 of the folding unit 3 are a conveying mechanism that conveys sheet(s), a folding mechanism that folds the conveyed sheet(s), and an additional folding mechanism that presses a crease(s) formed in the sheet. A feature of the first embodiment lies in the configuration of the additional folding mechanism included in the folding unit 3.

The dedicated device 80 of the finisher unit 4 is a finisher mechanism that performs a finishing process on a sheet(s) conveyed from the image forming unit 2 or from the folding unit 3. The dedicated devices 80 of the scanner unit 5 are a document reading mechanism that optically reads an image of a document and an automatic conveying mechanism that automatically conveys a sheet(s).

With the hardware configuration described above, programs stored in a storage medium such as the ROM 30, the HDD 40, or an optical disk (not shown) are loaded onto the RAM 20. The CPU 10 executes processing in accordance with the programs loaded onto the RAM 20, thereby generating software control modules. Functional blocks that perform the functions of the image forming apparatus 1 according to the first embodiment are implemented in a combination of the software control modules implemented as described above and the hardware.

Figure 4:
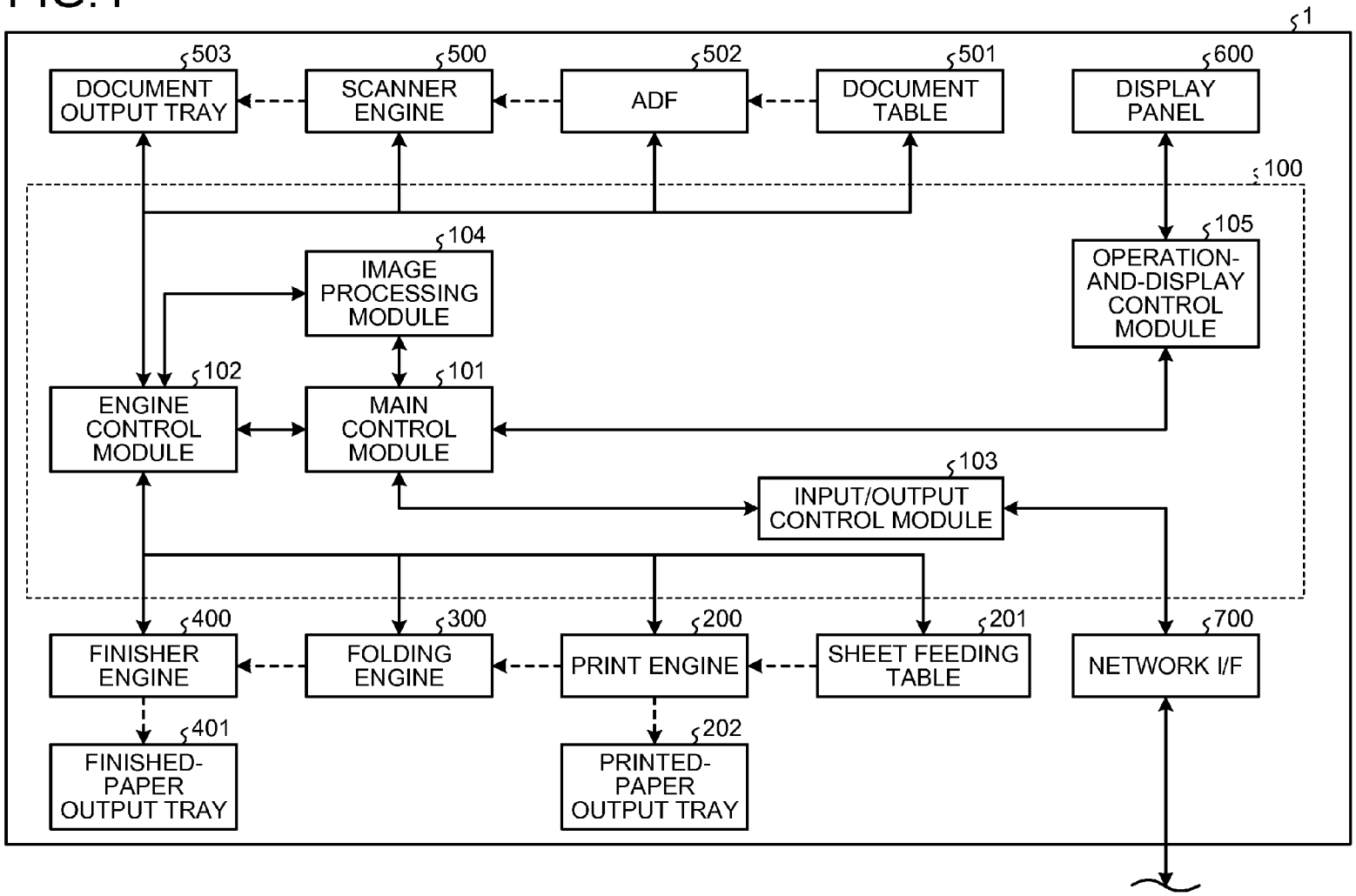
FIG. 4 is a block diagram schematically illustrating a functional configuration of the image forming apparatus according to the first embodiment.

A functional configuration of the image forming apparatus 1 according to the first embodiment is described below with reference to FIG. 4. FIG. 4 is a block diagram schematically illustrating the functional configuration of the image forming apparatus 1 according to the first embodiment. In FIG. 4, electrical connections are indicated by solid lines with arrow heads; flows of a sheet (bundle) or a document (bundle) are indicated by dashed lines with arrow heads.

As illustrated in FIG. 4, the image forming apparatus 1 according to the first embodiment includes a controller 100, a print engine 200, a sheet feeding table 201, a printed-paper output tray 202, a folding engine 300, a finisher engine 400, a finished-paper output tray 401, a scanner engine 500, a document table 501, an ADF (automatic document feeder) 502, a document output tray 503, a display panel 600, and a network I/F 700. The controller 100 includes a main control module 101, an engine control module 102, an input/output control module 103, an image processing module 104, and an operation-and-display control module 105.

The print engine 200, which is an image forming part included in the image forming unit 2, prints an image by forming an image on a sheet conveyed from the sheet feeding table 201. Specific examples of the print engine 200 include an inkjet image forming mechanism and an electrophotographic image forming mechanism.

The sheet where the image is printed (formed) by the print engine 200 is either conveyed to the folding unit 3 or ejected onto the printed-paper output tray 202. The print engine 200 is embodied by the dedicated device 80 illustrated in FIG. 3. The sheet feeding table 201 feeds a sheet to the print engine 200 which is the image forming part.

The folding engine 300 included in the folding unit 3 performs a folding process and an additional folding process on the image-formed sheet conveyed from the image forming unit 2. The folded sheet having undergone the folding process performed by the folding engine 300 is conveyed to the finisher unit 4. The folding engine 300 is embodied by the dedicated device 80 illustrated in FIG. 3.

The finisher engine 400 included in the finisher unit 4 performs finishing such as stapling, hole punching, or book binding on the sheet(s) conveyed from the folding engine 300. The sheet(s) having undergone the finishing performed by the finisher engine 400 is ejected onto the finished-paper output tray 401. The finisher engine 400 is embodied by the dedicated device 80 illustrated in FIG. 3.

The scanner engine 500 included in the scanner unit 5 is the document reading part including a photoelectric converter that converts optical information into electrical signals. The scanner engine 500 reads an image of a document automatically conveyed from the document table 501 by the ADF 502 or a document placed on an exposure glass by optically scanning the document to thereby generate image information.

The document automatically conveyed from the document table 501 by the ADF 502 and read by the scanner engine 500 is ejected onto the document output tray 503. The scanner engine 500 is embodied by the dedicated device 80 illustrated in FIG. 3. The ADF 502 included in the scanner unit 5 automatically conveys a document placed on the document table 501 to the scanner engine 500. The ADF 502 is embodied by the dedicated device 80 illustrated in FIG. 3.

The display panel 600 is an output interface that provides visual display of a condition of the image forming apparatus 1 and also an input interface for use by a user in directly operating the image forming apparatus 1 or entering information to the image forming apparatus 1. Accordingly, the display panel 600 has a function of displaying images for receiving operations made by a user. The display panel 600 is embodied by the display part 60 and the operation part 70 illustrated in FIG. 3.

The network I/F 700 is an interface that allows the image forming apparatus 1 to communicate with other equipment such as an administrator's terminal or a PC (personal computer) via a network. As the network I/F 700, an interface such as Ethernet (registered trademark), USB (universal serial bus), Bluetooth (registered trademark), Wi-Fi (registered trademark) (Wireless Fidelity), or FeliCa (registered trademark) may be used. As described above, the image forming apparatus 1 according to the first embodiment receives image data printing of which is requested, and various control commands such as a print request from a terminal connected to the image forming apparatus 1 via the network I/F 700. The network I/F 700 is embodied by the I/F 50 illustrated in FIG. 3.

The controller 100 is implemented in a combination of software and hardware. More specifically, control programs such as firmware stored in a non-volatile storage medium such as the ROM 30 or the HDD 40 are loaded onto the RAM 20. The CPU 10 executes processing in accordance with the programs, thereby generating software control modules. The controller 100 is implemented in the software control modules and hardware such as an integrated circuit. The controller 100 functions as a control part that controls the entire image forming apparatus 1.

The main control module 101 performs a function of controlling the modules included in the controller 100 and feeds commands to the modules of the controller 100. The main control module 101 controls the input/output control module 103 and accesses other equipment via the network I/F 700 and a network.

The engine control module 102 controls drivers of the print engine 200, the folding engine 300, the finisher engine 400, the scanner engine 500, and the like or causes the same to drive. The input/output control module 103 feeds signals and commands input to the controller 100 via the network I/F 700 and the network to the main control module 101.

The image processing module 104 generates, under control of the main control module 101, print information from image information, which may be, for example, document data or image data contained in an input print job, described in PDL (page description language) or the like and outputs the generated print information. The print information is information such as CMYK bitmap data in accordance with which the print engine 200, which is the image forming part, prints an image by performing an image forming operation.

The image processing module 104 processes scanned-image data fed from the scanner engine 500, thereby generating image data. The image data is information to be stored in the image forming apparatus 1 or transmitted to other equipment via the network I/F 700 and the network as a result of a scanning operation. Meanwhile, the image forming apparatus 1 according to the first embodiment is configured to be also capable of producing a printout by forming an image based on, in lieu of image information, print information directly fed to the image forming apparatus 1.

The operation-and-display control module 105 displays information on the display panel 600 or notifies the main control module 101 of information input to the image forming apparatus 1 from the display panel 600.

An example of how the folding unit 3 according to the first embodiment folds a sheet in z-fold is described below with reference to FIGS. 5A to 7C. FIGS. 5A to 7C are cross-sectional diagrams, as viewed along the main-scanning direction, of the folding unit 3 of the image forming apparatus 1 according to the first embodiment performing a folding operation.

Figure 5A:
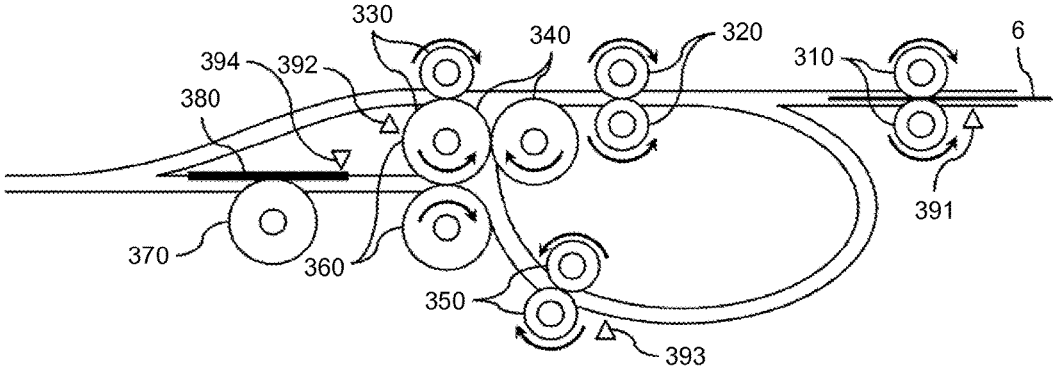
FIGS. 5A to 5C are cross-sectional diagrams, as viewed along the main-scanning direction, of a folding unit of the image forming apparatus according to the first embodiment performing a folding operation.

How the folding unit 3 according to the first embodiment folds a sheet in z-fold is described below. As illustrated in FIG. 5A, when a sheet 6 is conveyed from the image forming unit 2 to the folding unit 3, a leading end in a conveying direction of the sheet 6 is detected by a first sheet detection sensor 391. Upon detecting the leading end, the folding unit 3 causes rollers to start rotating. The folding unit 3 receives the sheet 6 conveyed from the image forming unit 2 at a pair of entrance conveying rollers 310 which conveys the sheet 6 toward a pair of registration rollers 320.

Figure 5B:
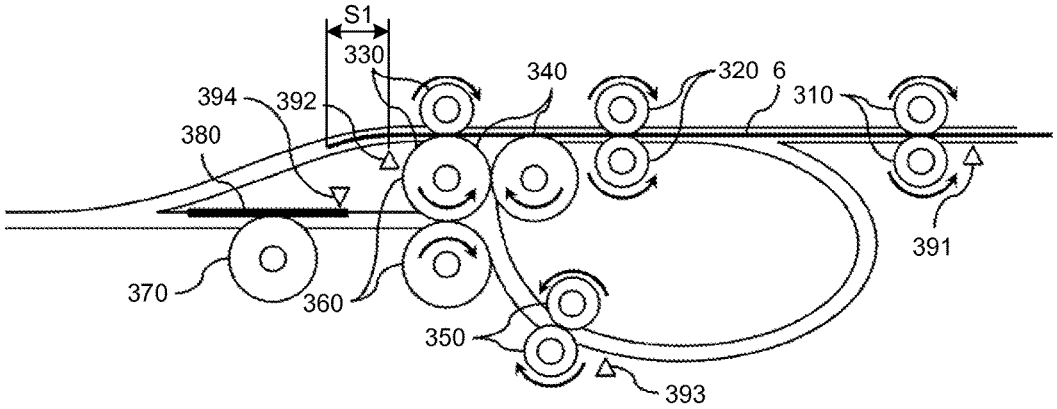

After performing registration of the sheet 6 conveyed by the pair of entrance conveying rollers 310 using the pair of registration rollers 320, the folding unit 3 conveys the sheet 6 further downstream in the conveying direction using a first pair of reversely-rotatable rollers 330 as illustrated in FIG. 5B.

Figure 5C:
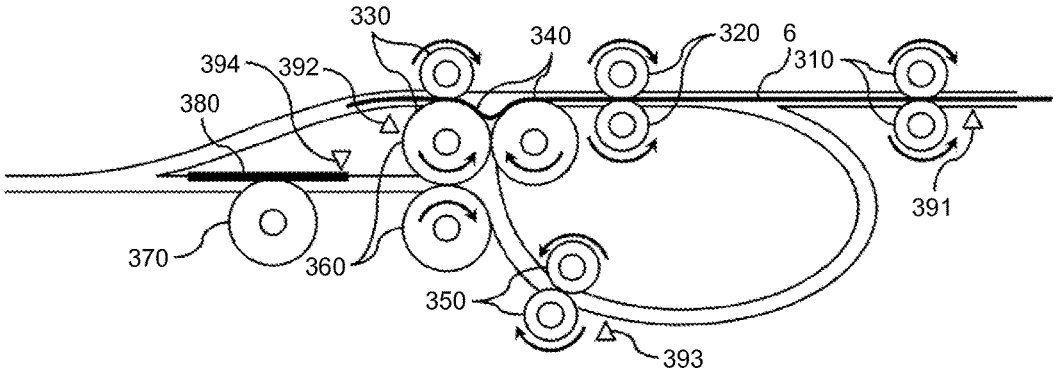

Thereafter, upon detection of the leading end in the conveying direction of the sheet 6, the folding unit 3 conveys the sheet 6 a predetermined distance S1 by a second sheet detection sensor 392. Then, as illustrated in FIG. 5C, the folding unit 3 reverses the rotating direction of the first pair of reversely-rotatable rollers 330 to elastically curve a first crease position of the sheet 6 toward a first pair of folding rollers 340, and further conveys the sheet 6 while preventing the curved portion from being displaced, thereby bringing the curved portion to a nip between the first pair of folding rollers 340. At this time, the folding unit 3 detects that the sheet 6 has been conveyed the distance S1 on the basis of a pulse count, or a rotation speed and rotation time of the first pair of reversely-rotatable rollers 330.

Figure 6A:
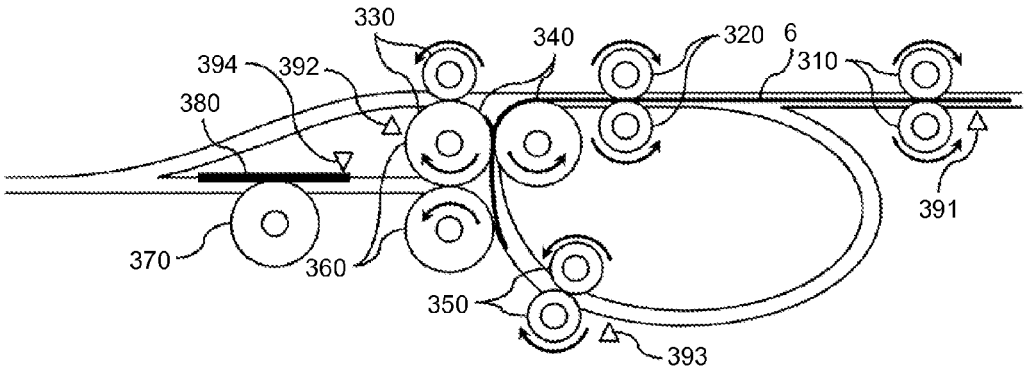
FIGS. 6A to 6C are cross-sectional diagrams, as viewed along the main-scanning direction, of the folding unit of the image forming apparatus according to the first embodiment performing the folding operation.
Figure 6B:
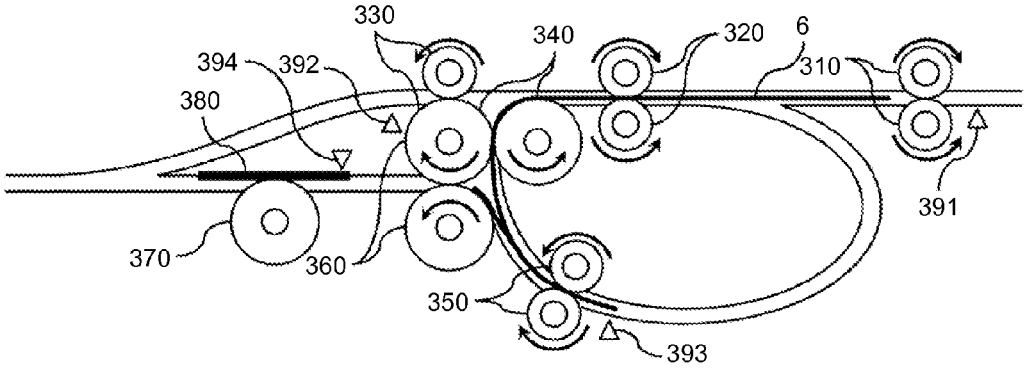
Figure 6C:
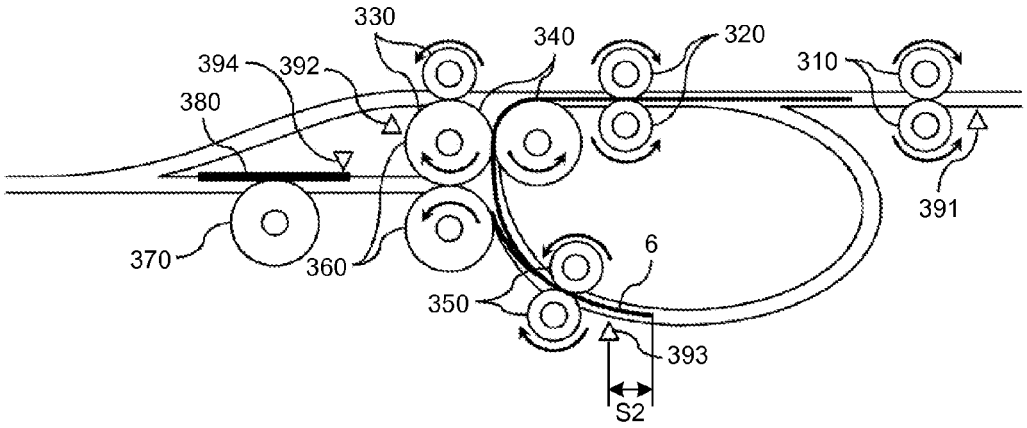

The folding unit 3 pinches the curved portion formed in the sheet 6 at the nip between the first pair of folding rollers 340, thereby forming a crease at the first crease position as illustrated in FIG. 6A. The folding unit 3 conveys the sheet 6 toward a second pair of reversely-rotatable rollers 350 to further convey the sheet 6 downstream in the conveying direction as illustrated in FIGS. 6B and 6C.

Figure 7A:
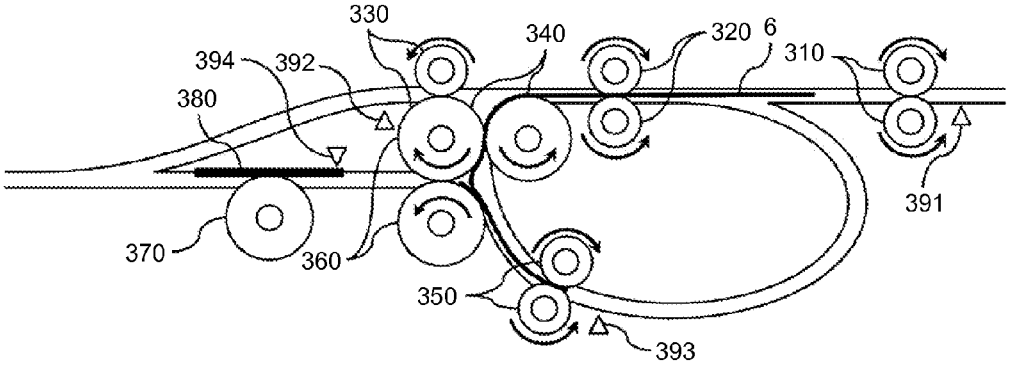
FIGS. 7A to 7C are cross-sectional diagrams, as viewed along the main-scanning direction, of the folding unit of the image forming apparatus according to the first embodiment performing the folding operation.

Thereafter, upon detection of the leading end in the conveying direction of the sheet 6 by a third sheet detection sensor 393, the folding unit 3 conveys the sheet 6 a predetermined distance S2. Then, as illustrated in FIG. 7A, the folding unit 3 reverses the rotating direction of the second pair of reversely-rotatable rollers 350 to elastically curve a second crease position of the sheet 6 toward a second pair of folding rollers 360, and further conveys the sheet 6 while preventing the curved portion from being displaced, thereby bringing the curved portion to a nip between the second pair of folding rollers 360. At this time, the folding unit 3 detects that the sheet 6 has been conveyed the distance S2 on the basis of a pulse count, or a rotation speed and rotation time of the second pair of reversely-rotatable rollers 350.

Figure 7B:
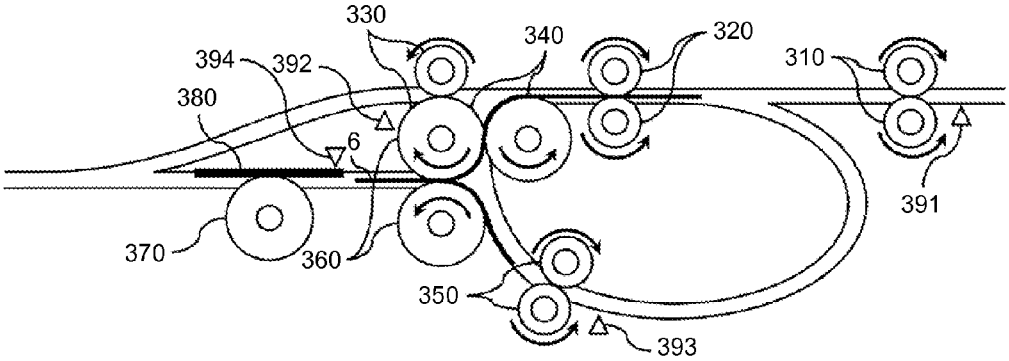

The folding unit 3 pinches the curved portion formed in the sheet 6 at the nip between the second pair of folding rollers 360, thereby forming a crease at the second crease position as illustrated in FIG. 7B. The folding unit 3 conveys the sheet 6 toward a clearance between an additional folding roller 370 and a sheet support plate 380.

Figure 7C:
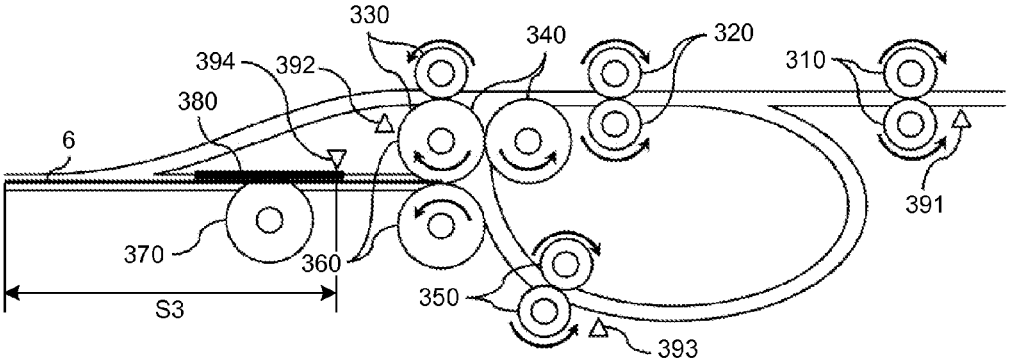

Thereafter, upon detection of the end in the conveying direction of the sheet 6 by a fourth sheet detection sensor 394, the folding unit 3 performs an additional folding operation by causing the additional folding roller 370 to press each crease formed in the sheet 6 against the sheet support plate 380 as illustrated in FIG. 7C, and thereafter conveys the sheet 6 to the finisher unit 4. Hence, in the first embodiment, the fourth sheet detection sensor 394 functions as an end-portion detector; the additional folding roller 370 functions as a presser. At this time, the folding unit 3 detects that the sheet 6 has been conveyed the distance S3 on the basis of a pulse count, or a rotation speed and rotation time of the second pair of folding rollers 360. Hence, in the first embodiment, the second pair of folding rollers 360 functions as a conveying unit.

Figure 8:
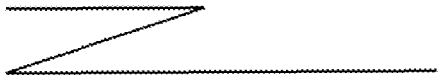
FIG. 8 is a diagram illustrating an example of a sheet folded in z-fold by the folding unit according to the first embodiment.
Figure 9A:
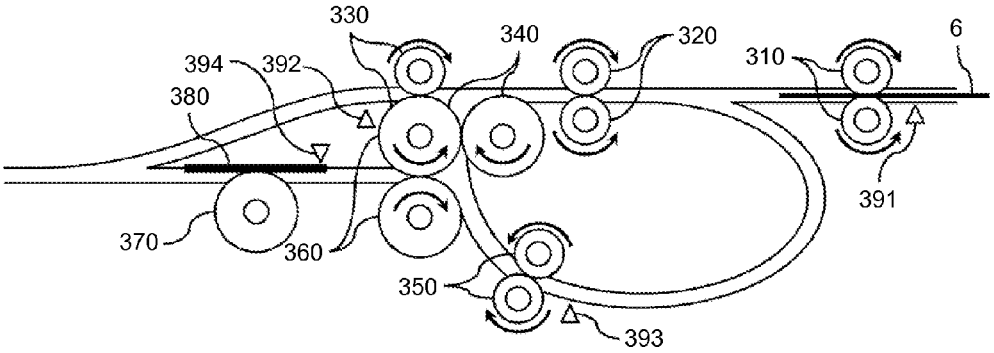
FIGS. 9A to 9C are cross-sectional diagrams, as viewed along the main-scanning direction, of the folding unit of the image forming apparatus according to the first embodiment performing a folding operation.
Figure 9B:
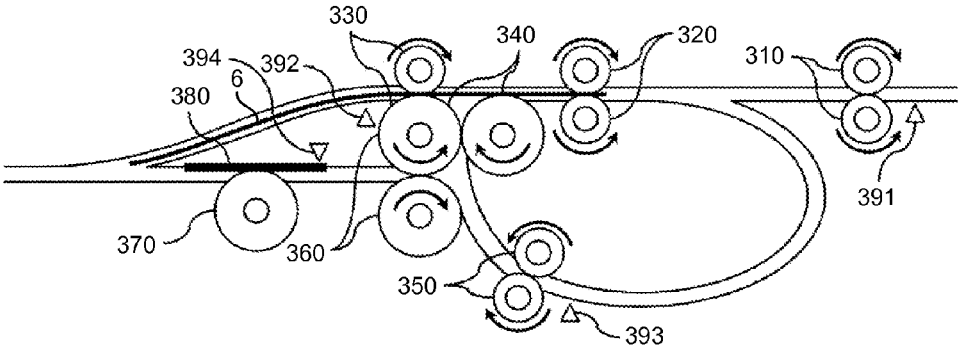
Figure 9C:
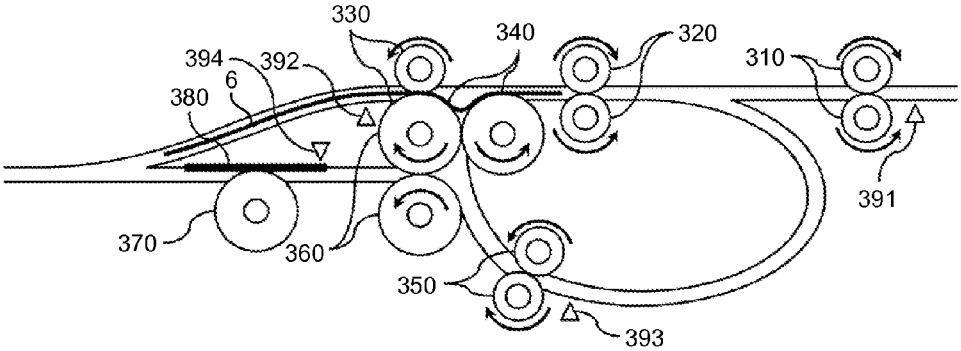
Figure 10A:
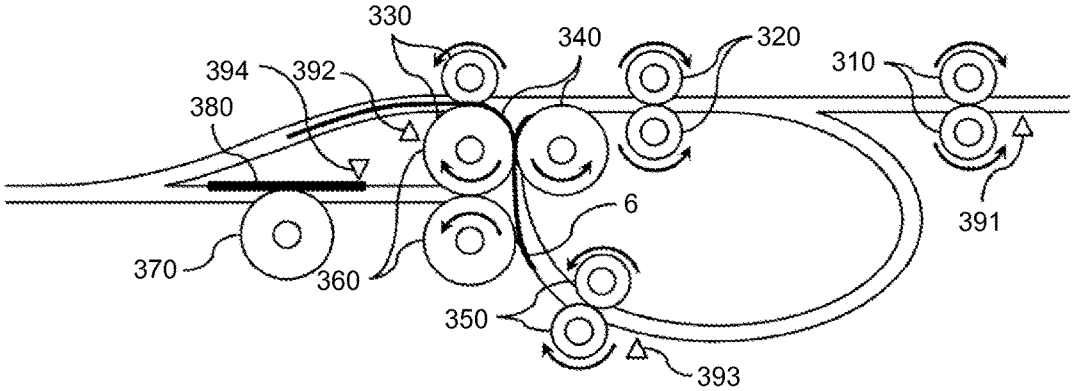
FIGS. 10A to 10C are cross-sectional diagrams, as viewed along the main-scanning direction, of the folding unit of the image forming apparatus according to the first embodiment performing the folding operation.
Figure 10B:
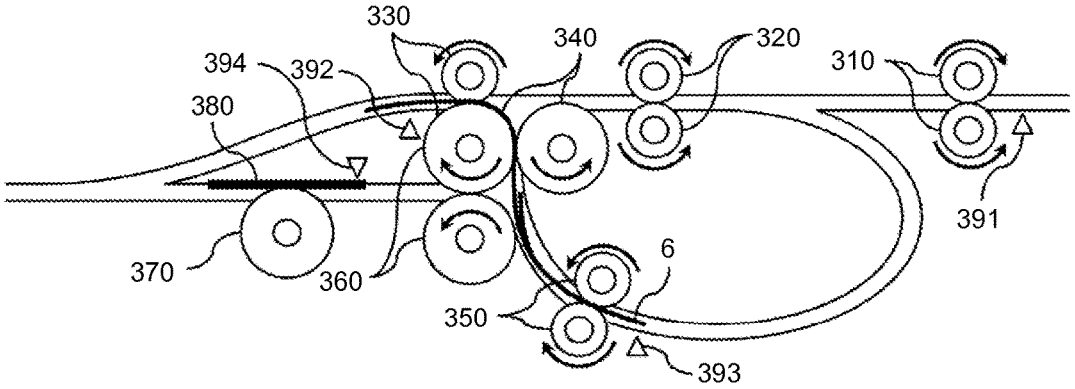
Figure 10C:
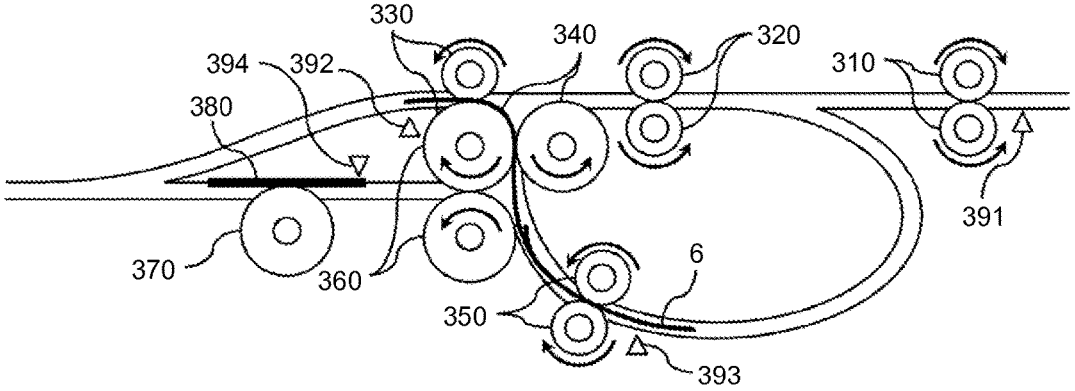
Figure 11A:
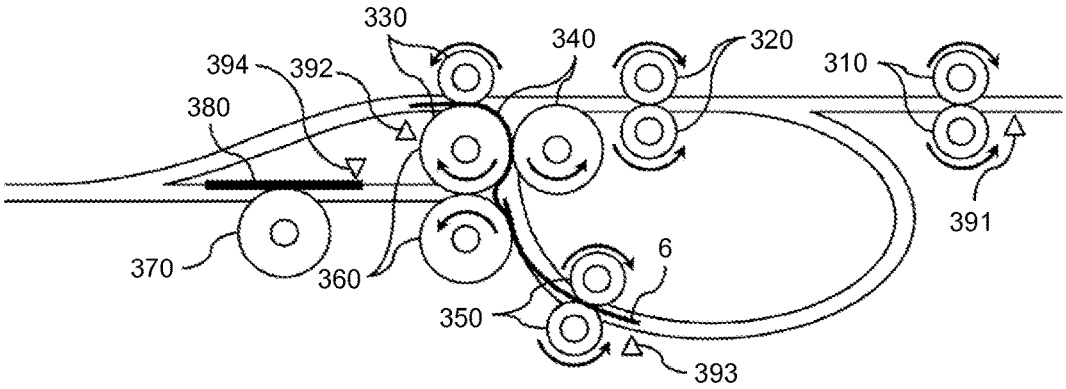
FIGS. 11A to 11C are cross-sectional diagrams, as viewed along the main-scanning direction, of the folding unit of the image forming apparatus according to the first embodiment performing the folding operation.
Figure 11B:
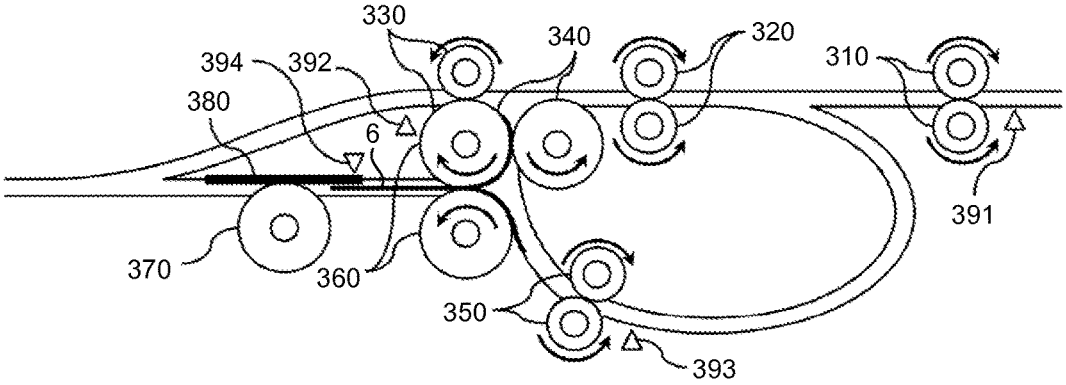
Figure 11C:
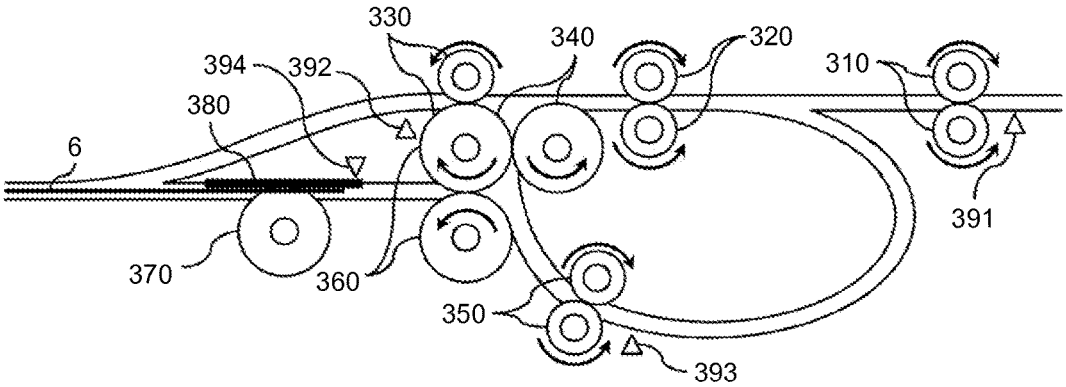

As a result of the operations illustrated in FIGS. 5A to 7C, the sheet 6 is folded in z-fold as illustrated in FIG. 8.

Figure 12:
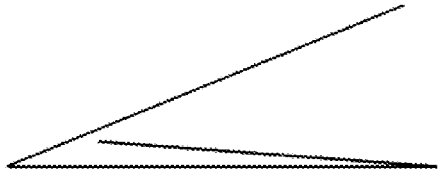
FIG. 12 is a diagram illustrating an example of a sheet folded in inward tri-fold by the folding unit according to the first embodiment.
Figure 13A:
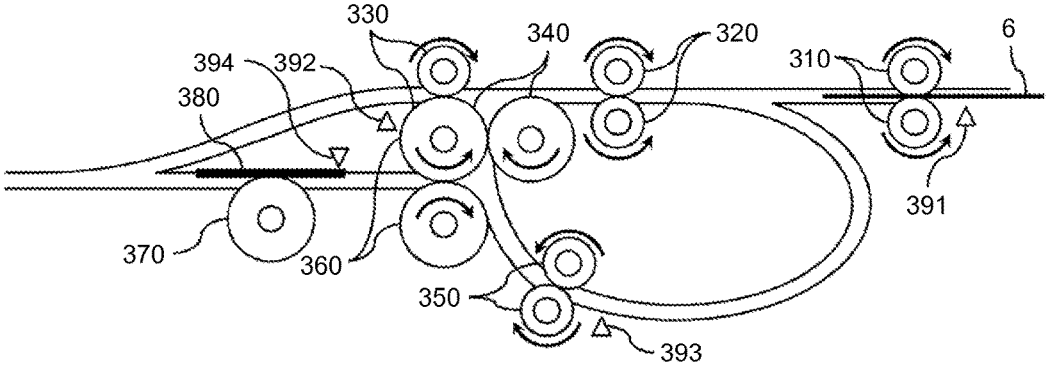
FIGS. 13A to 13C are cross-sectional diagrams, as viewed along the main-scanning direction, of the folding unit of the image forming apparatus according to the first embodiment performing a folding operation.
Figure 13B:
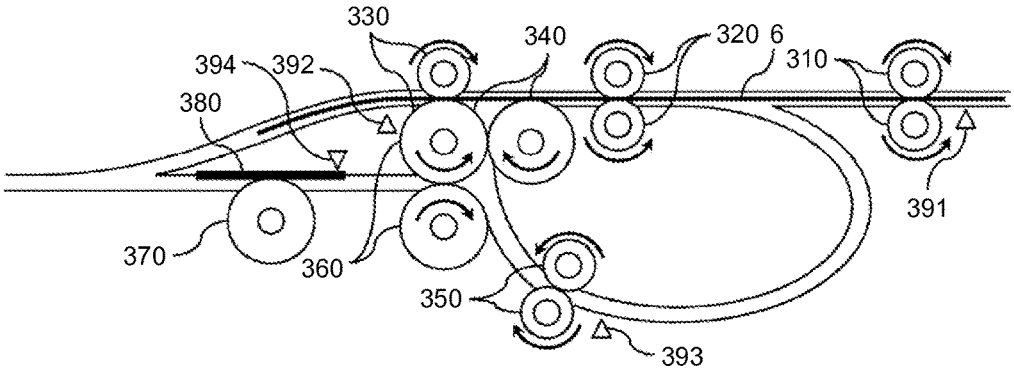
Figure 13C:
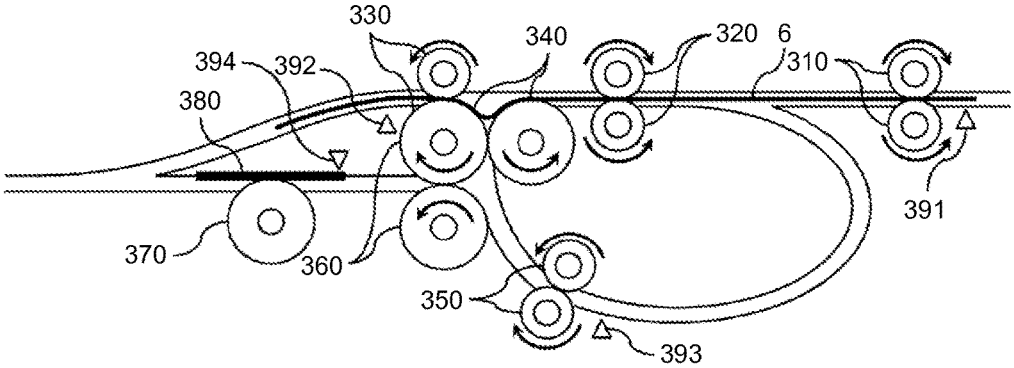
Figure 14A:
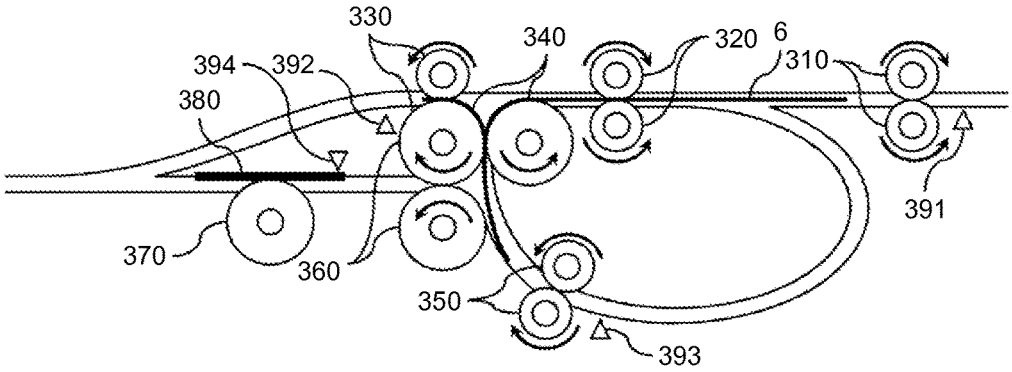
FIGS. 14A to 14C are cross-sectional diagrams, as viewed along the main-scanning direction, of the folding unit of the image forming apparatus according to the first embodiment performing the folding operation.
Figure 14B:
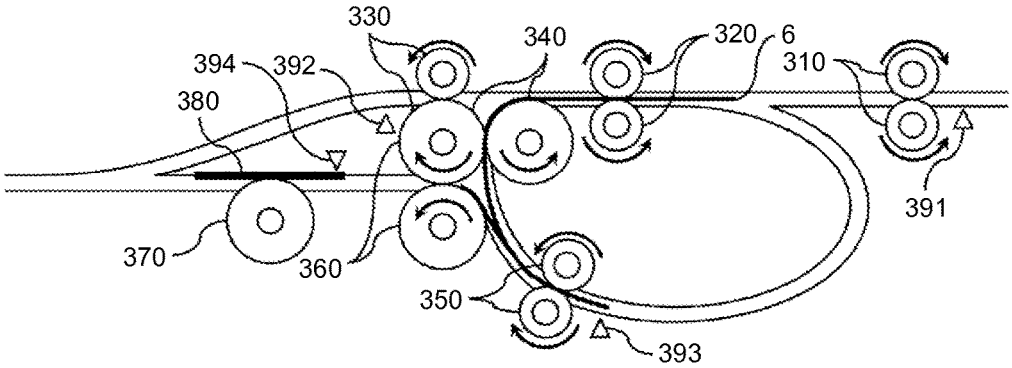
Figure 14C:
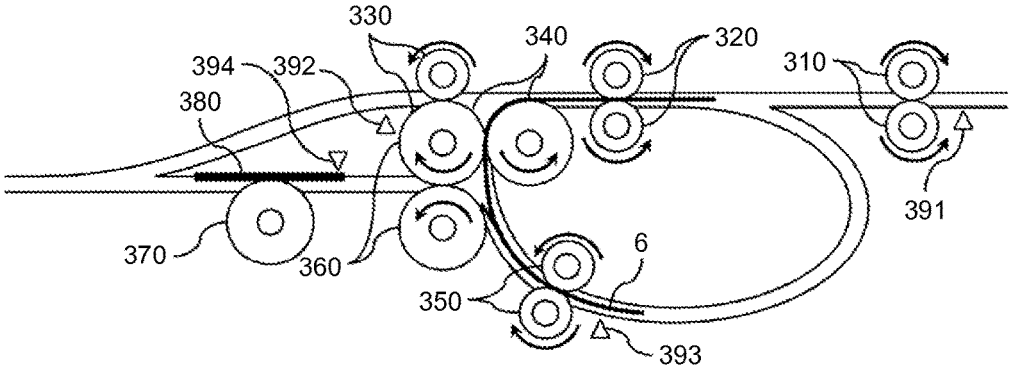
Figure 15A:
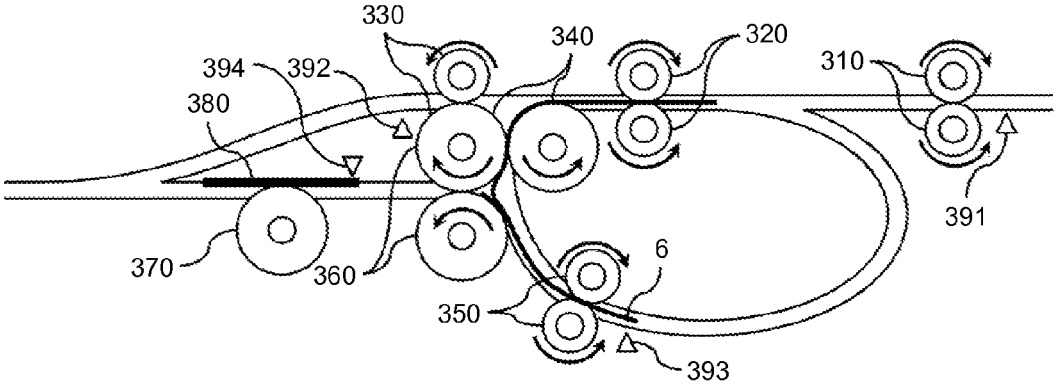
FIGS. 15A to 15C are cross-sectional diagrams, as viewed along the main-scanning direction, of the folding unit of the image forming apparatus according to the first embodiment performing the folding operation.
Figure 15B:
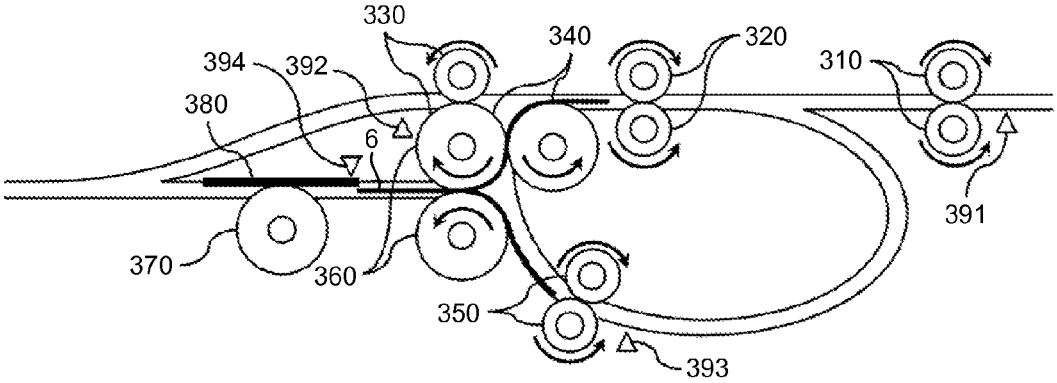
Figure 15C:
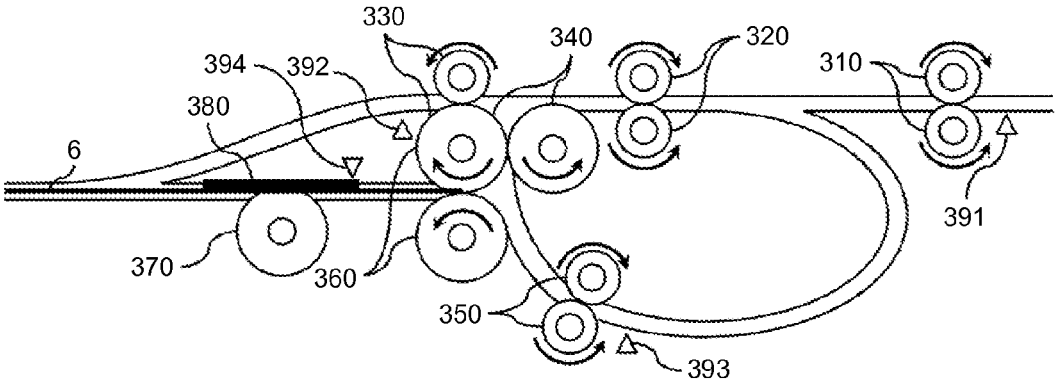

The example in which the folding unit 3 folds the sheet 6 in z-fold has been described with reference to FIGS. 5A to 7C. The folding unit 3 can fold the sheet 6 in inward tri-fold through the operations illustrated in FIGS. 9A to 11C. When undergoing the operations, the sheet 6 is folded in inward tri-fold as illustrated in FIG. 12.

Figure 16:
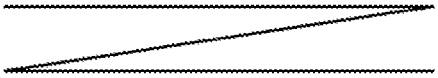
FIG. 16 is a diagram illustrating an example of a sheet folded in outward tri-fold by the folding unit according to the first embodiment.

The folding unit 3 can fold the sheet 6 in outward tri-fold through the operations illustrated in FIGS. 13A to 15C. When undergoing the operations, the sheet 6 is folded in outward tri-fold as illustrated in FIG. 16.

The operations illustrated in FIGS. 9A to 11C and those illustrated in FIGS. 13A to 15C are similar to those described above with reference to FIGS. 5A to 7C except that the distance S1, the distance S2, and the distance S3 vary depending on a fold type and the size of the sheet 6. For this reason, the folding unit 3 changes, depending on a fold type and the size of the sheet 6, timing for reversing the rotating direction of the first pair of reversely-rotatable rollers 330, timing for reversing the rotating direction of second pair of reversely-rotatable rollers 350, and timing for performing the additional folding operation using the additional folding roller 370.

The distances S1, S2, and S3 are determined in advance for each combination of fold types and sizes of the sheet 6 and stored in a non-volatile storage medium such as the ROM 30 or the HDD 40. However, the distances S1, S2, and S3 may be changed or additionally set by user settings or the like. More specifically, in the folding unit 3 according to the first embodiment, a position where a crease is to be formed may be set in addition to crease positions of predetermined fold types or changed from one of the crease positions by user settings or the like. In such a case, the main control module 101 additionally sets or changes a crease position where the crease is to be formed. Hence, in the first embodiment, the main control module 101 functions as a setting unit.

Example structures of the additional folding roller 370 according to the first embodiment are described below with reference to FIGS. 17 to 20 and FIGS. 21 to 24.

Figure 17:
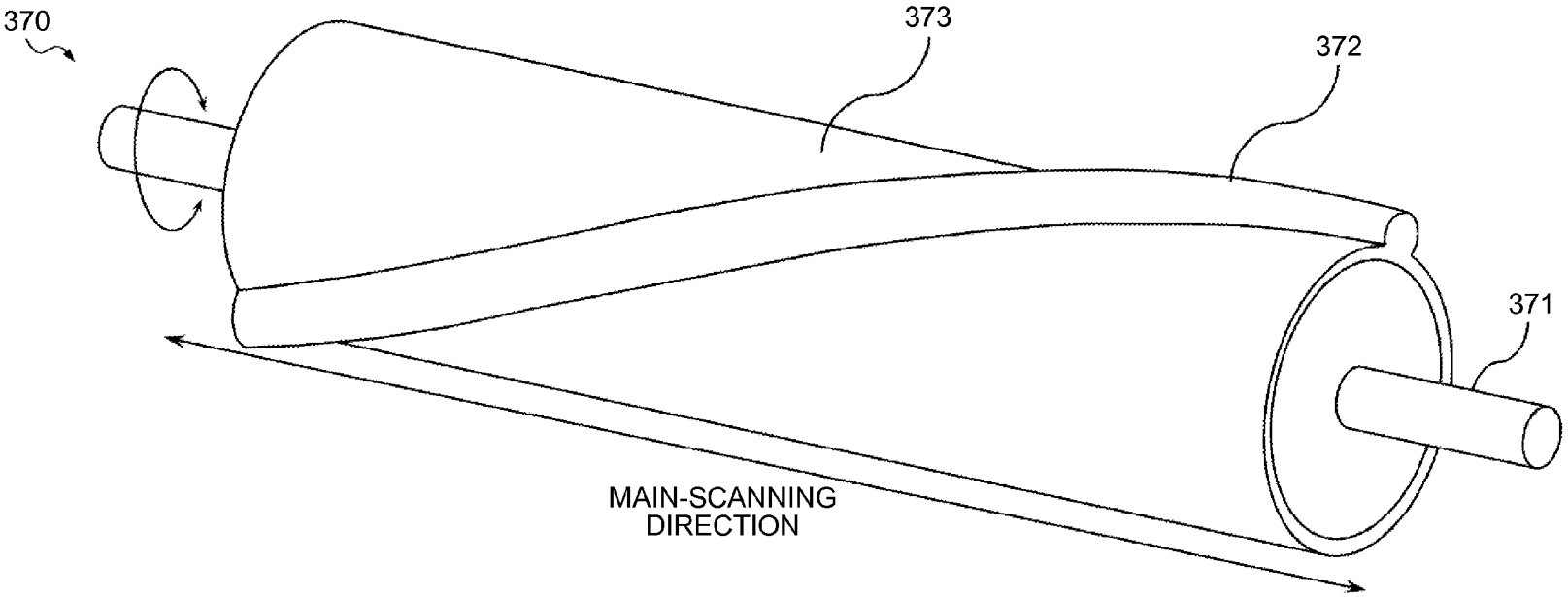
FIG. 17 is a perspective view of a first example structure of an additional folding roller according to the first embodiment as viewed obliquely from above relative to the main-scanning direction.
Figure 18:
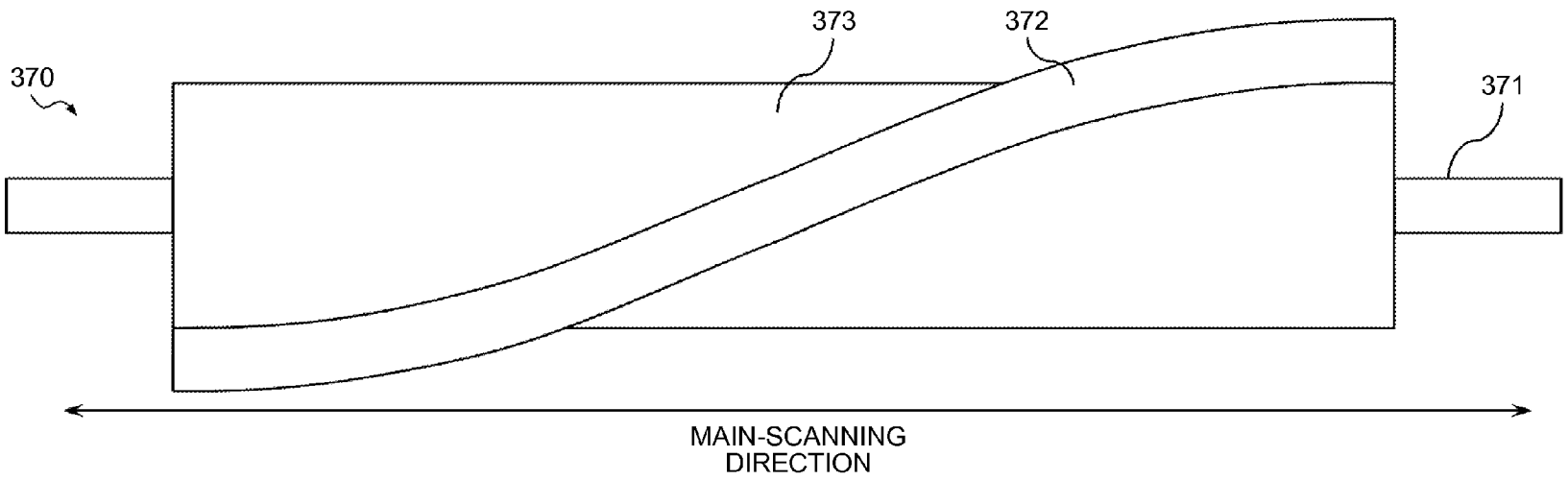
FIG. 18 is a front view of the first example structure of the additional folding roller according to the first embodiment as viewed along the sub-scanning direction.
Figure 19:
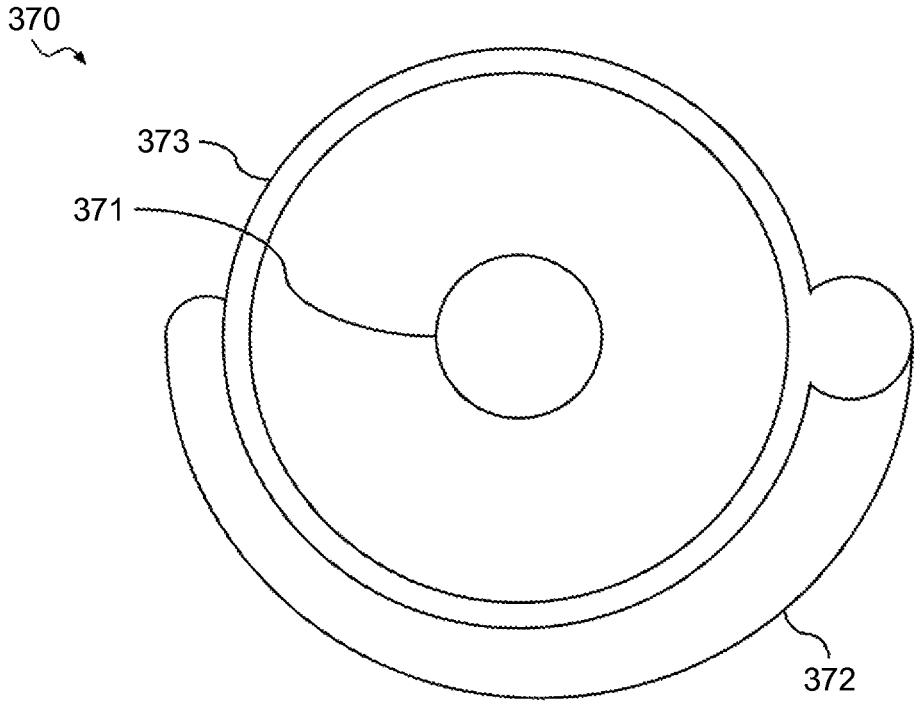
FIG. 19 is a side view of the first example structure of the additional folding roller according to the first embodiment as viewed along the main-scanning direction.
Figure 20:
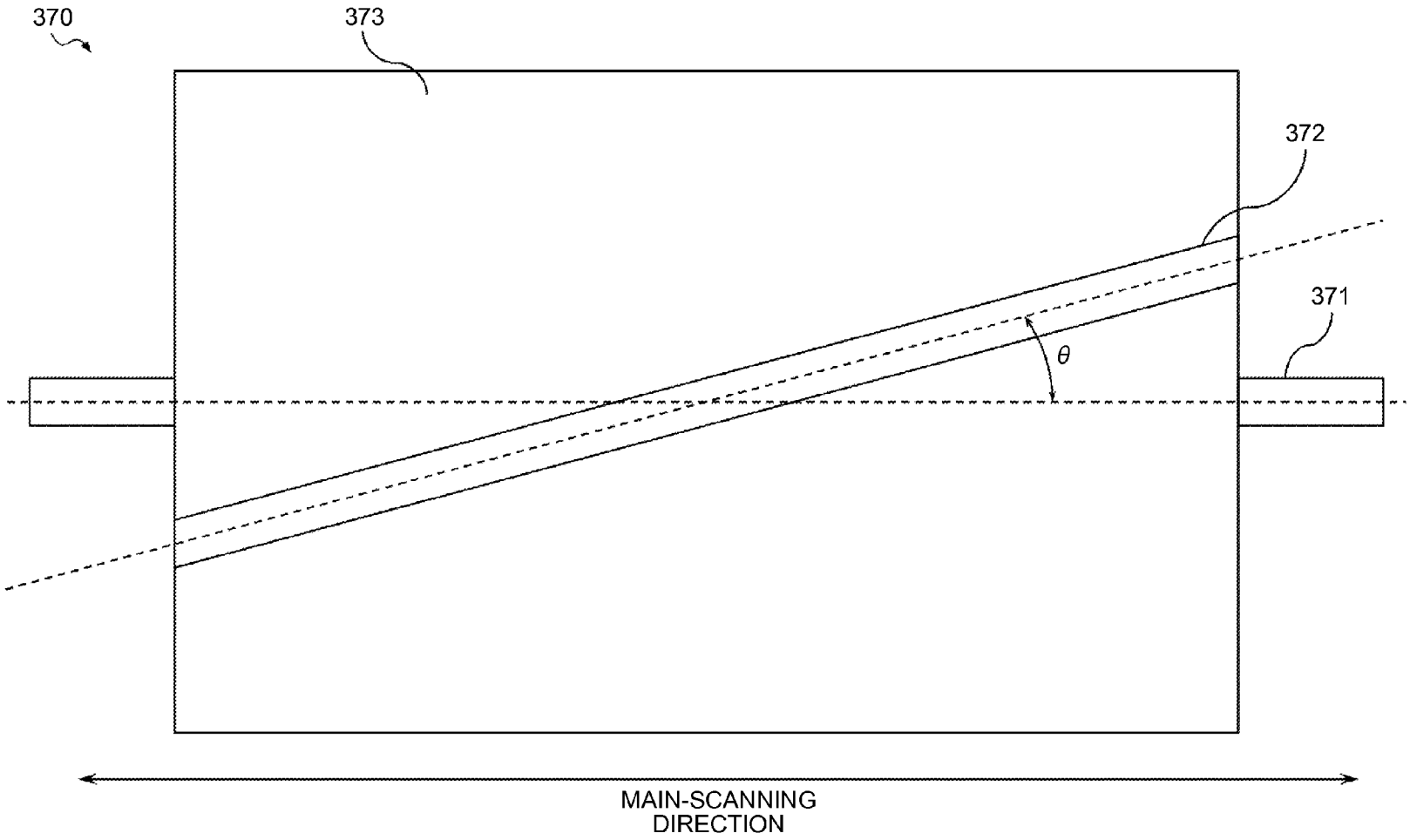
FIG. 20 is a developed diagram of the first example structure of the additional folding roller according to the first embodiment.

A first example structure of the additional folding roller 370 according to the first embodiment is described below with reference to FIGS. 17 to 20. FIG. 17 is a perspective view of the first example structure of the additional folding roller 370 according to the first embodiment as viewed obliquely from above relative to the main-scanning direction. FIG. 18 is a front view of the first example structure of the additional folding roller 370 according to the first embodiment as viewed along the sub-scanning direction. FIG. 19 is a side view of the first example structure of the additional folding roller 370 according to the first embodiment as viewed along the main-scanning direction. FIG. 20 is a developed diagram of the first example structure of the additional folding roller 370 according to the first embodiment.

In the first example structure of the additional folding roller 370 according to the first embodiment, a rib-like pressing-force transmission part 372 is disposed on a circumferential surface of a pressing-force transmission roller 373 that rotates on an additional folding-roller rotation shaft 371 that rotates about an axis extending in the main-scanning direction as illustrated in FIGS. 17 to 20. The pressing-force transmission part 372 is disposed in a helical arrangement extending along the main-scanning direction and having a fixed angle difference θ with respect to the additional folding-roller rotation shaft 371. By being configured as such, the additional folding roller 370 of the first example structure according to the first embodiment makes contact with a crease formed in the sheet 6 only at a portion (hereinafter, "contact portion") of the pressing-force transmission part 372.

This structure allows the additional folding roller 370 of the first example structure according to the first embodiment to rotate about the additional folding-roller rotation shaft 371, thereby pressing the crease formed in the sheet 6 gradually in one direction along the main-scanning direction.

Hence, the folding unit 3 having the first example structure can apply a focused pressing force throughout the crease in a short period of time. Accordingly, the folding unit 3 having the first example structure can apply the sufficient pressing force to the crease while reducing a load placed on the additional folding-roller rotation shaft 371 without lowering productivity.

Figure 21:
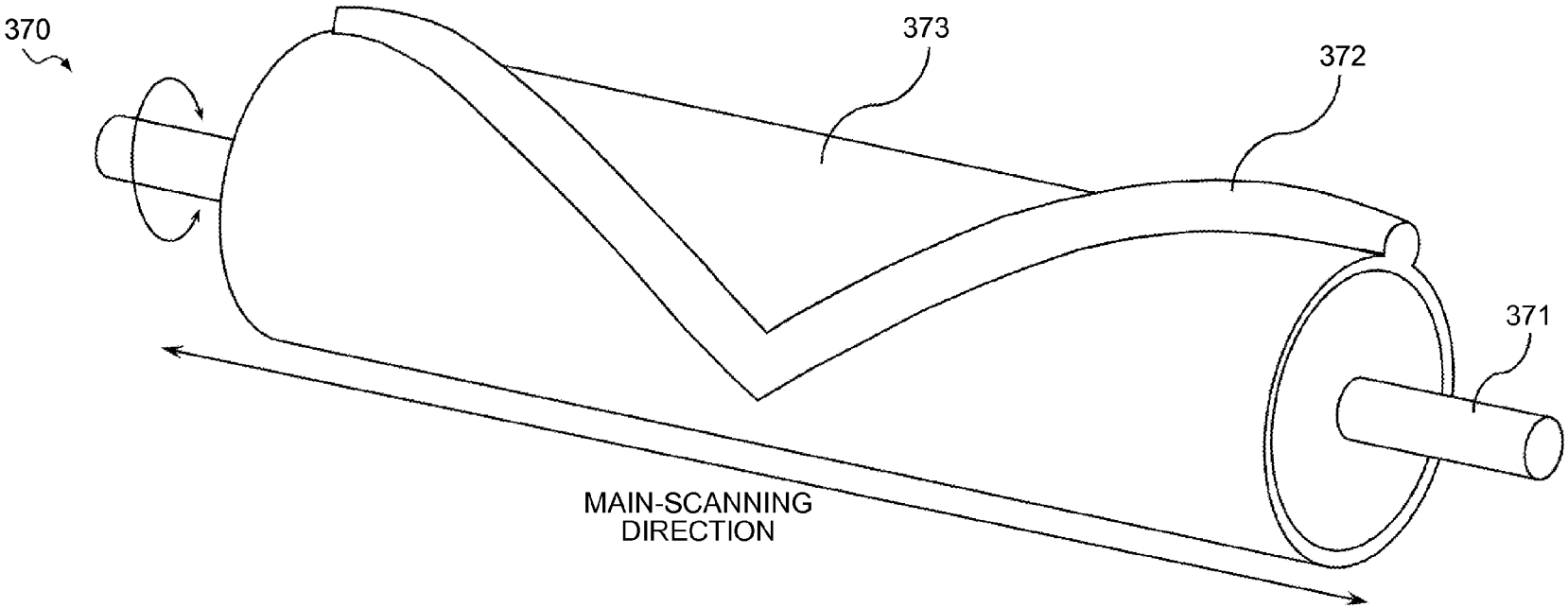
FIG. 21 is a perspective view of a second example structure of the additional folding roller according to the first embodiment as viewed obliquely from above relative to the main-scanning direction.
Figure 22:
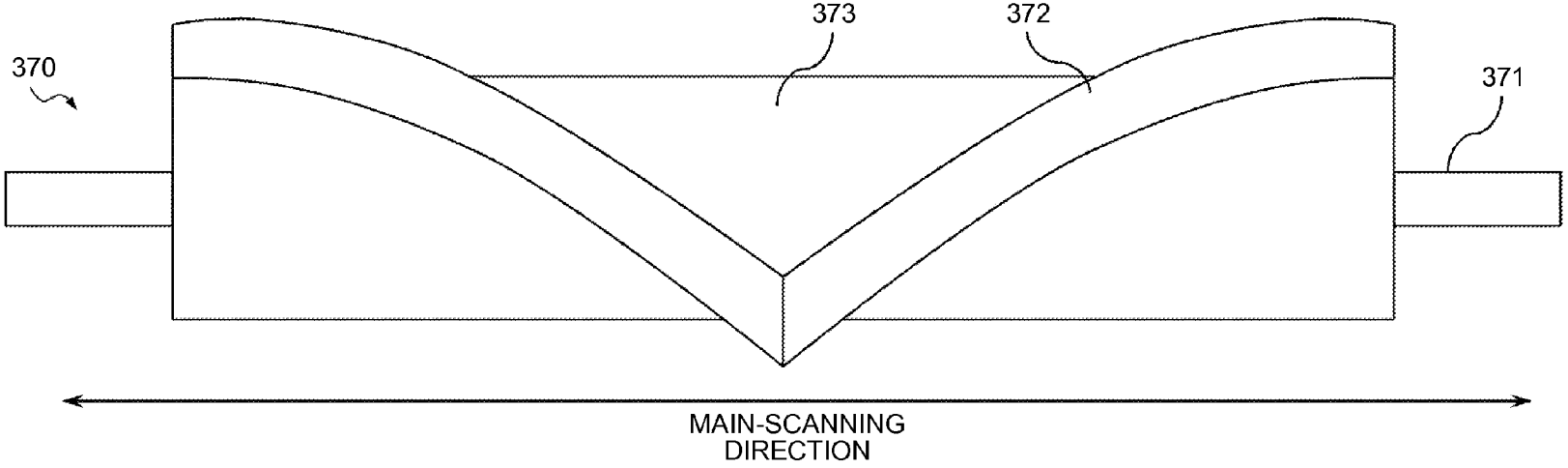
FIG. 22 is a front view of the second example structure of the additional folding roller according to the first embodiment as viewed along the sub-scanning direction.
Figure 23:
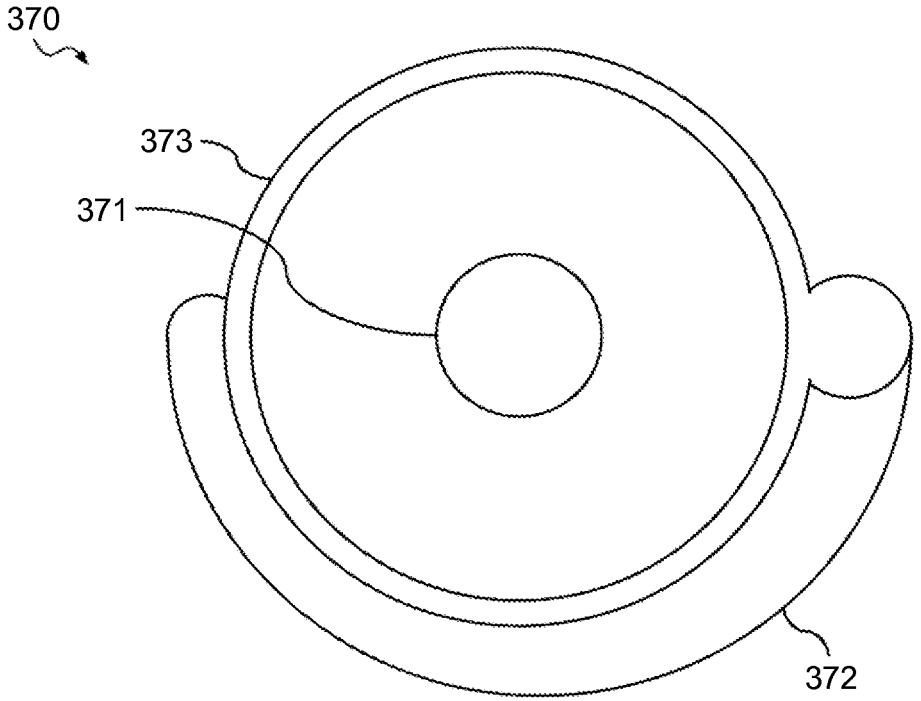
FIG. 23 is a side view of the second example structure of the additional folding roller according to the first embodiment as viewed along the main-scanning direction.
Figure 24:
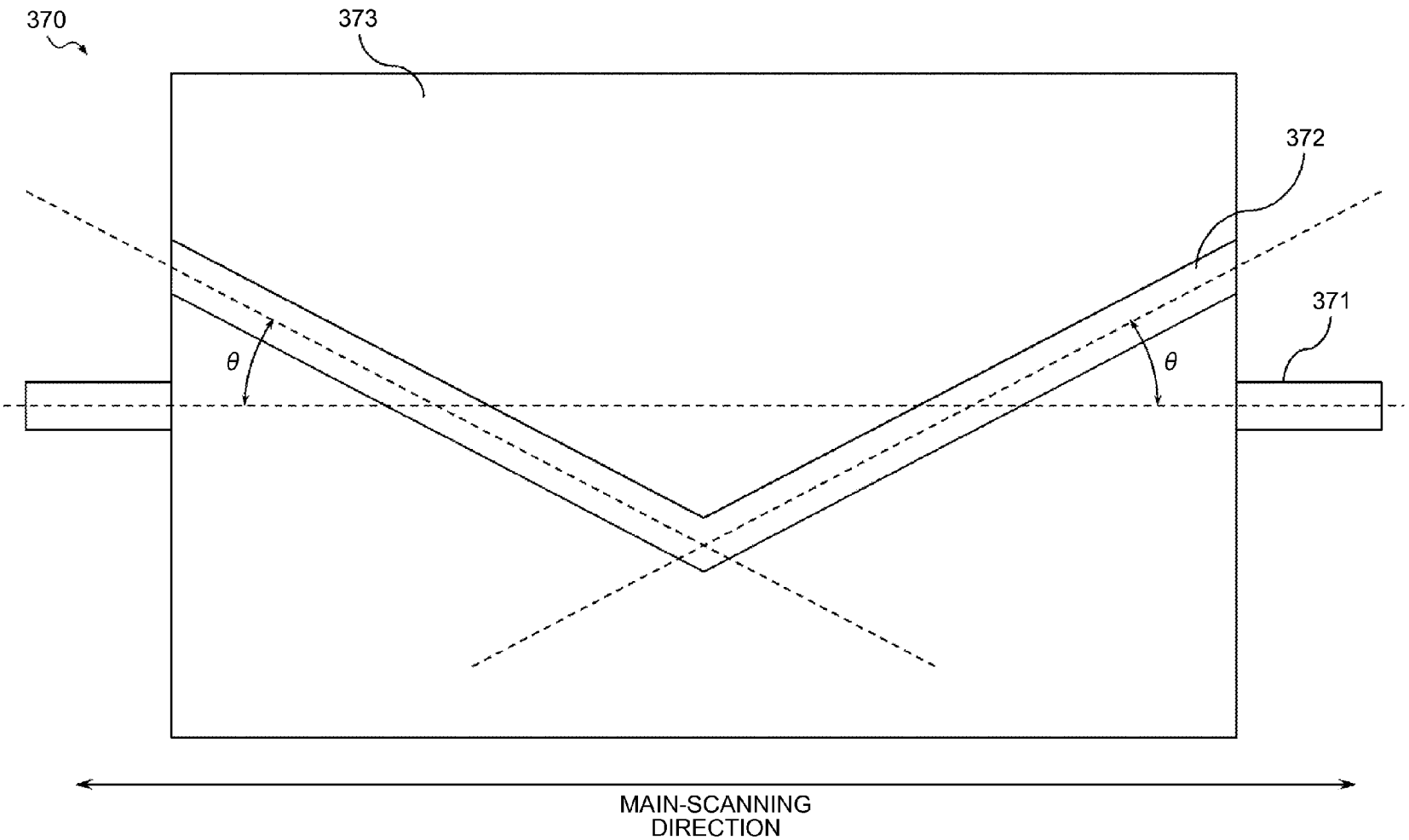
FIG. 24 is a developed diagram of the second example structure of the additional folding roller according to the first embodiment.

A second example structure of the additional folding roller 370 according to the first embodiment is described below with reference to FIGS. 21 to 24. FIG. 21 is a perspective view of the second example structure of the additional folding roller 370 according to the first embodiment as viewed obliquely from above relative to the main-scanning direction. FIG. 22 is a front view of the second example structure of the additional folding roller 370 according to the first embodiment as viewed along the sub-scanning direction. FIG. 23 is a side view of the second example structure of the additional folding roller 370 according to the first embodiment as viewed along the main-scanning direction. FIG. 24 is a developed diagram of the second example structure of the additional folding roller 370 according to the first embodiment.

In the second example structure of the additional folding roller 370 according to the second embodiment, the rib-like pressing-force transmission part 372 is disposed on the circumferential surface of the pressing-force transmission roller 373 in a helical arrangement extending in the main-scanning direction and having the fixed angle difference θ with respect to the additional folding-roller rotation shaft 371 while assuming a V-shape that is symmetric with respect to the center in the main-scanning direction of the additional folding roller 370 as illustrated in FIGS. 21 to 24. By being configured as such, the additional folding roller 370 of the second example structure according to the first embodiment makes contact with a crease formed in the sheet 6 simultaneously at two portions (hereinafter, "contact portions") of the pressing-force transmission part 372.

This structure allows the additional folding roller 370 of the second example structure according to the first embodiment to rotate about the additional folding-roller rotation shaft 371, thereby pressing the crease formed in the sheet 6 gradually in opposite directions along the main-scanning direction.

Hence, although the folding unit 3 having the second example structure is lower in pressing force than the structure illustrated in FIGS. 17 to 20, the folding unit 3 having the second example structure can apply a focused pressing force throughout the crease in a shorter period of time than the structure illustrated in FIGS. 17 to 20. Accordingly, the folding unit 3 having the second example structure can apply the sufficient pressing force to the crease while reducing a load placed on the additional folding-roller rotation shaft 371 and increasing productivity.

An example of how the folding unit 3 according to the first embodiment performs the additional folding operation is described below with reference to FIGS. 25A to 27. FIGS. 25A to 26F are cross-sectional diagrams, as viewed along the main-scanning direction, of the additional folding roller 370 and the sheet support plate 380 of the folding unit 3 according to the first embodiment performing the additional folding operation. FIG. 27 is diagram illustrating how sheet conveying speed and rotation speed of the additional folding roller 370 change with time when the folding unit 3 according to the first embodiment is performing the additional folding operation. An example where the additional folding operation is performed on the sheet 6 folded in z-fold to have a first crease 6*a* and a second crease 6*b* is described below with reference to FIGS. 25A to 27.

Figure 25A:
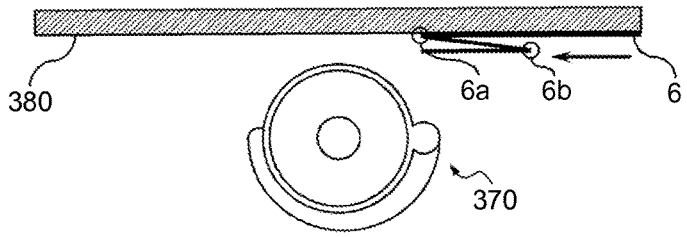
FIGS. 25A to 25F are cross-sectional diagrams, as viewed along the main-scanning direction, of the additional folding roller and a sheet support plate of the folding unit according to the first embodiment performing an additional folding operation.
Figure 25B:
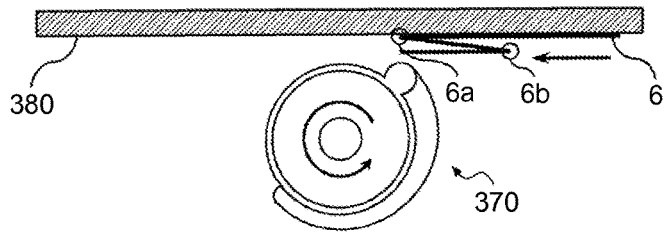
Figure 26A:
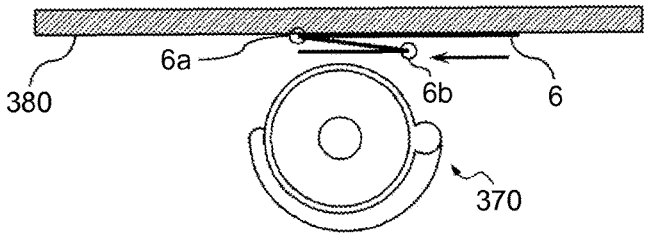
FIGS. 26A to 26F are cross-sectional diagrams, as viewed along the main-scanning direction, of the additional folding roller and the sheet support plate of the folding unit according to the first embodiment performing the additional folding operation.
Figure 26B:
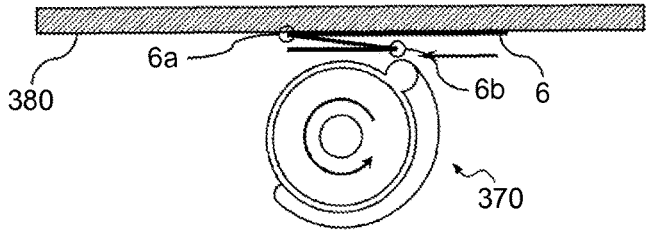

Upon starting conveyance of the sheet 6 as illustrated in FIGS. 25A and 27, the folding unit 3 according to the first embodiment causes the additional folding roller 370 to start rotating without waiting for the sheet 6 to stop as illustrated in FIGS. 25B and 27. The reason why the folding unit 3 according to the first embodiment causes the additional folding roller 370 to start rotating without waiting for the sheet 6 to stop is to reduce time lag between when the additional folding roller 370 starts rotating and when the additional folding roller 370 contacts the sheet 6. Hence, the folding unit 3 according to the first embodiment can increase productivity.

Figure 25C:
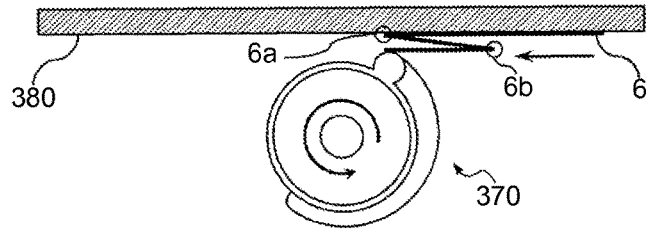
Figure 25D:
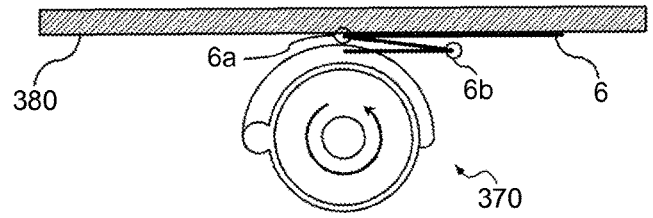

The folding unit 3 starts pressing the first crease 6*a* formed in the sheet 6 by bringing the additional folding roller 370 into contact with the first crease 6*a* as illustrated in FIGS. 25C and 27. As illustrated in FIGS. 25D and 27, when the sheet 6 is conveyed until the first crease 6*a* is situated immediately above the additional folding-roller rotation shaft 371, the folding unit 3 completely stops conveyance of the sheet 6 while causing the additional folding roller 370 to continue rotating, thereby continuing pressing the first crease 6*a* formed in the sheet 6.

Figure 25E:
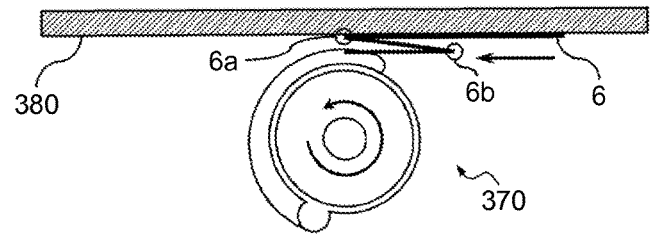

Thereafter, the folding unit 3 starts conveying the sheet 6 without waiting for the additional folding roller 370 to stop as illustrated in FIGS. 25E and 27. The reason why the folding unit 3 according to the first embodiment starts conveying the sheet 6 without waiting for the additional folding roller 370 to stop is to reduce time lag between when the additional folding roller 370 goes out of contact with the sheet 6 and when the additional folding roller 370 completely stops. Hence, the folding unit 3 according to the first embodiment can increase productivity.

Figure 25F:
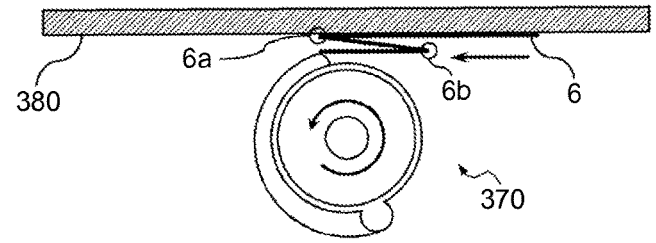

As illustrated in FIGS. 25F and 27, the folding unit 3 conveys the sheet 6 that has come out of contact with the additional folding roller 370. Thereafter, the folding unit 3 causes the additional folding roller 370 to stop rotating as illustrated in FIGS. 26A and 27, and causes the additional folding roller 370 to start rotating without waiting for the sheet 6 to stop as illustrated in FIGS. 26B and 27. The reason why the folding unit 3 according to the first embodiment causes the additional folding roller 370 to start rotating without waiting for the sheet 6 to stop is to reduce time lag between when the additional folding roller 370 starts rotating and when the additional folding roller 370 comes into contact with the sheet 6. Hence, the folding unit 3 according to the first embodiment can increase productivity.

Figure 26C:
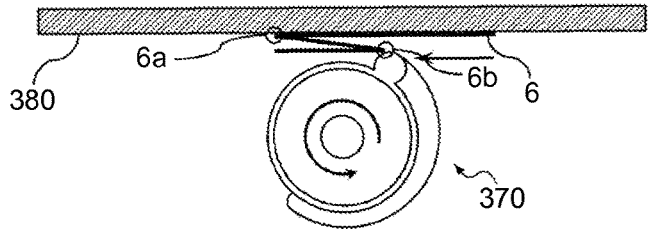
Figure 26D:
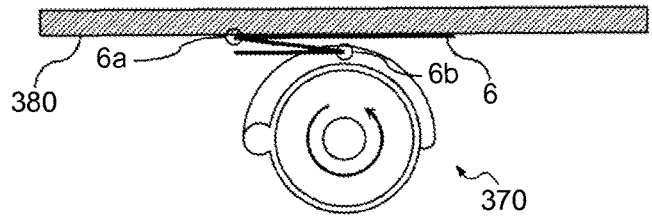
Figure 27:
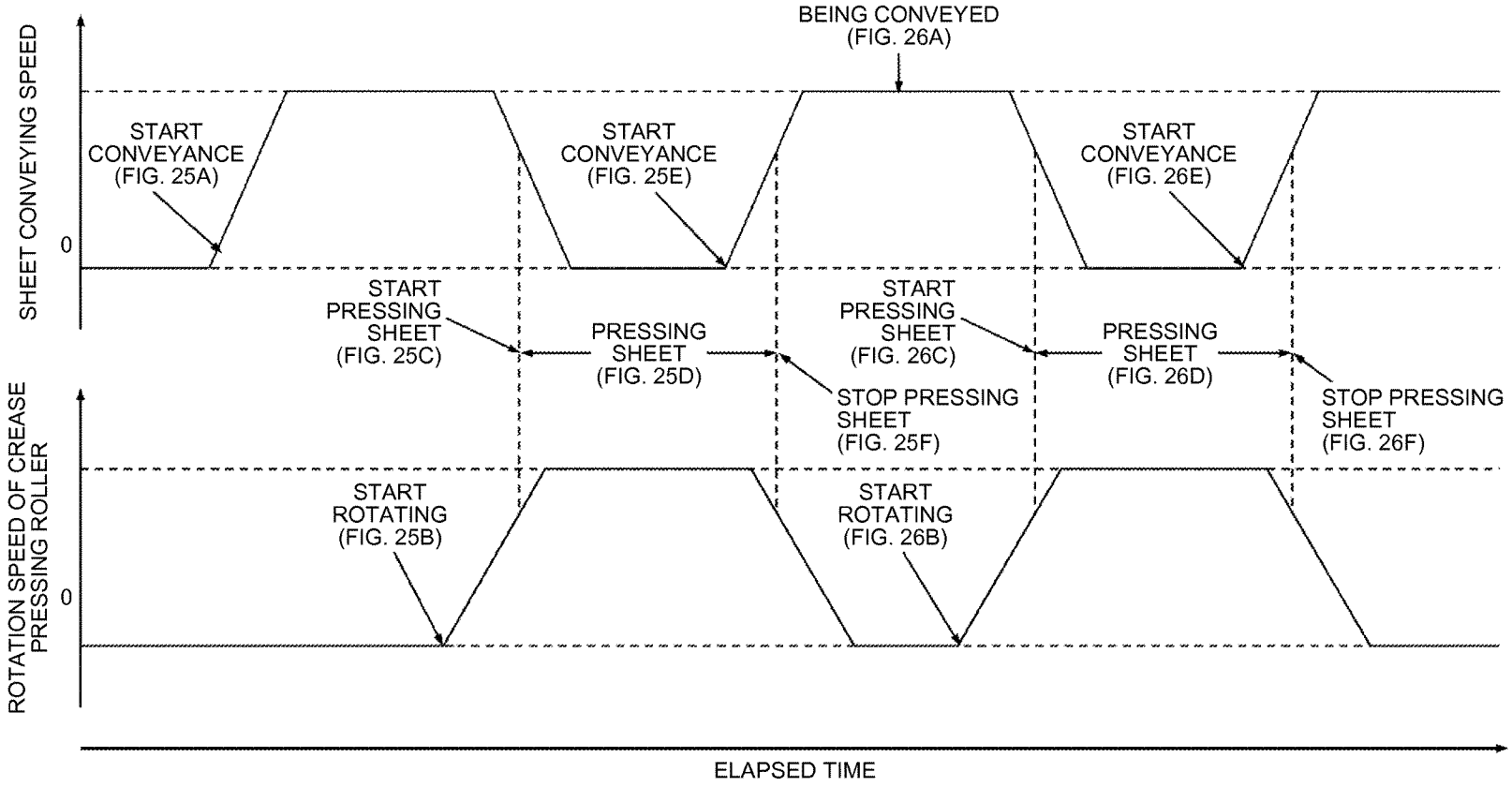
FIG. 27 is diagram illustrating how sheet conveying speed and rotation speed of the additional folding roller change with time when the folding unit according to the first embodiment is performing the additional folding operation.

The folding unit 3 starts pressing the second crease 6*b* formed in the sheet 6 by bringing the additional folding roller 370 into contact with the second crease 6*b* as illustrated in FIGS. 26C and 27. As illustrated in FIGS. 26D and 27, when the sheet 6 has been conveyed to the position where the second crease 6*b* is situated immediately above the additional folding-roller rotation shaft 371, the folding unit 3 completely stops conveyance of the sheet 6 while causing the additional folding roller 370 to continue rotating, thereby continuing pressing the second crease 6*b* formed in the sheet 6.

Figure 26E:
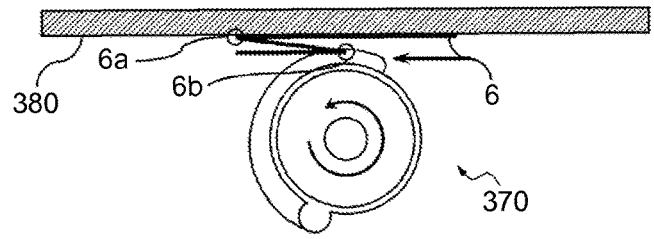

Thereafter, the folding unit 3 starts conveying the sheet 6 without waiting for the additional folding roller 370 to stop as illustrated in FIGS. 26E and 27. The reason why the folding unit 3 according to the first embodiment starts conveying the sheet 6 without waiting for the additional folding roller 370 to stop is to reduce time lag between when the additional folding roller 370 comes out of contact with the sheet 6 and when the additional folding roller 370 completely stops. Hence, the folding unit 3 according to the first embodiment can increase productivity.

Figure 26F:
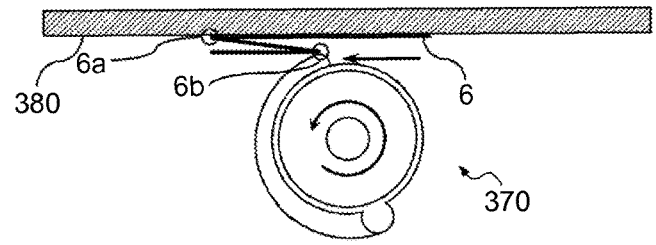

The additional folding operation is completed when the folding unit 3 conveys the sheet 6 that has come out of contact with the additional folding roller 370 as illustrated in FIGS. 26F and 27.

The folding unit 3 configured as described above does not always form a crease at a same position; rather, the folding unit 3 can change a position where a crease is to be formed depending on a fold type and the size of the sheet 6. Accordingly, if a position of a crease varies from one sheet to another, the folding unit can fail to press a crease formed in the sheet 6 accurately.

A feature of the folding unit 3 according to the first embodiment lies in that the press position in the additional folding operation is adjusted in accordance with a position of a crease formed in the sheet 6. This feature allows the folding unit 3 according to the first embodiment to press creases accurately.

Examples of how the folding unit 3 according to the first embodiment adjusts the press position in the additional folding operation are described below with reference to FIGS. 28A and 28B and FIGS. 29A and 29B.

Figure 28A:
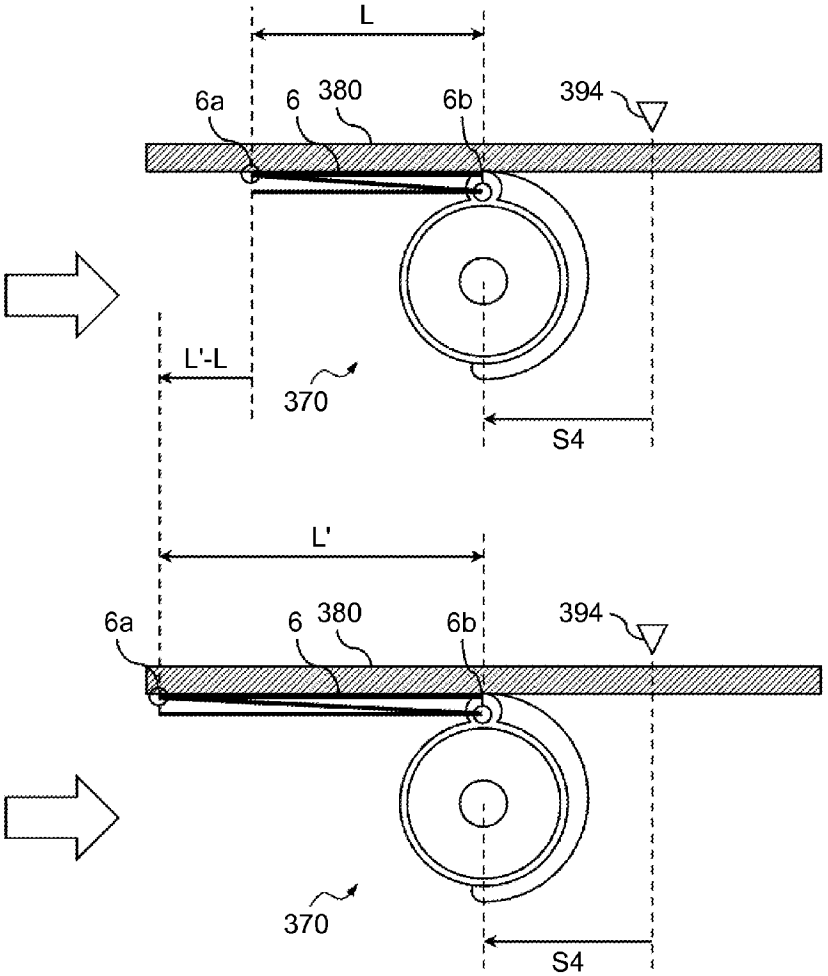
FIGS. 28A and 28B are diagrams illustrating a first example of how the folding unit according to the first embodiment adjusts a press position when performing the additional folding operation.
Figure 28B:
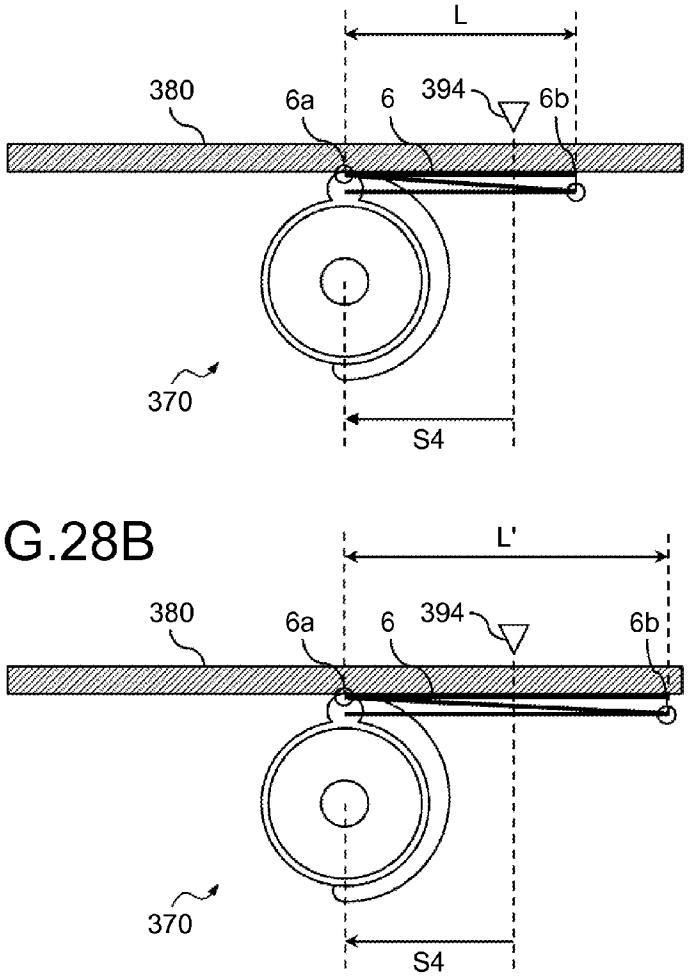

A first example of how the folding unit 3 according to the first embodiment adjusts the press position in the additional folding operation is described below with reference to FIGS. 28A and 28B. FIGS. 28A and 28B are diagrams illustrating the first example of how the folding unit 3 according to the first embodiment adjusts the press position in the additional folding operation.

FIGS. 28A and 28B illustrate an example in which the sheet 6 is folded in outward tri-fold with the first crease 6*a* and the second crease 6*b* formed on the leading end and the trailing end, respectively, in the conveying direction of the sheet 6. FIG. 28A differs from FIG. 28B in the distance between the first crease 6*a* and the second crease 6*b*.

The folding unit 3 according to the first embodiment performs the additional folding operation as described below. As illustrated in the left diagram of FIG. 28A, upon detection of the leading end in the conveying direction of the sheet 6 by the fourth sheet detection sensor 394, the folding unit 3 conveys the sheet 6 a predetermined distance S4 and stops conveyance.

The distance S4 is the distance between the fourth sheet detection sensor 394 and the additional folding roller 370 and stored in advance in a non-volatile storage medium such as the ROM 30 or the HDD 40. Accordingly, when the sheet 6 has been conveyed the predetermined distance S4, the leading end in the conveying direction of the sheet 6, namely, the first crease 6*a*, is situated immediately above the additional folding roller 370. The folding unit 3 presses the first crease 6*a* at this position.

After pressing the first crease 6*a*, the folding unit 3 starts conveying the sheet 6. As illustrated in the right diagram of FIG. 28A, upon detection of the trailing end in the conveying direction of the sheet 6 by the fourth sheet detection sensor 394, the folding unit 3 further conveys the sheet 6 the predetermined distance S4. When the sheet 6 has been conveyed the predetermined distance S4, the trailing end in the conveying direction of the sheet 6, namely, the second crease 6*b*, is situated immediately above the additional folding roller 370. The folding unit 3 presses the second crease 6*b* at this position.

Meanwhile, the folding unit 3 can change a position where a crease is to be formed depending on a fold type and the size of the sheet 6, or user settings. Accordingly, the need of changing the press position depending on a position of a crease when performing the additional folding operation arises.

In response to the need, the folding unit 3 according to the first embodiment is configured to change the distance (hereinafter, "conveying distance") that the sheet 6 is to be conveyed after the first crease 6*a* is pressed according to a change in position of a crease formed in the sheet 6 as illustrated in FIG. 28B. The example illustrated in FIG. 28B differs from the example illustrated in FIG. 28A in that the distance between the first crease 6*a* and the second crease 6*b* is changed from L to L'. Accordingly, after pressing the first crease 6*a*, the folding unit 3 changes the conveying distance of the sheet 6 by L-L'.

As described above, the folding unit 3 according to the first embodiment is configured to adjust the press position in accordance with a position of a crease formed in the sheet 6 by adjusting the conveying distance of the sheet 6 when performing the additional folding operation. Accordingly, the folding unit 3 according to the first embodiment can press a crease accurately even if the position of the crease varies from one sheet to another.

Figures 29A, 29B:
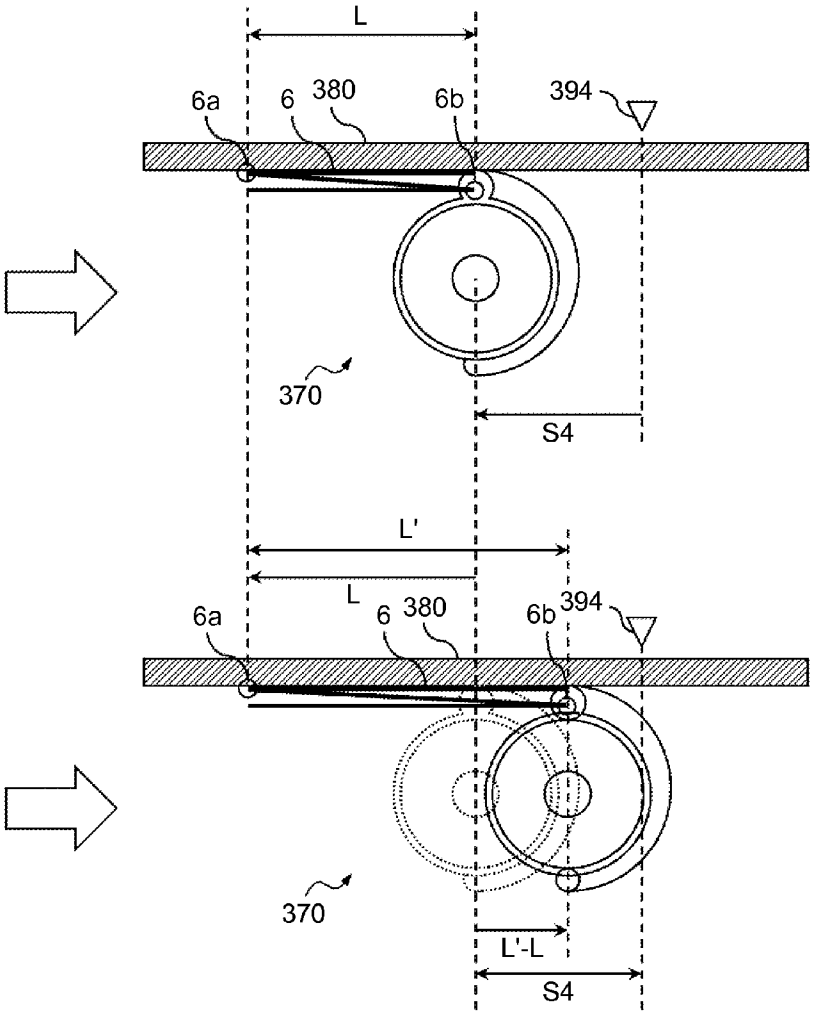
FIGS. 29A and 29B are diagrams illustrating a second example of how the folding unit according to the first embodiment adjusts a press position when performing the additional folding operation.

A second example of how the folding unit 3 according to the first embodiment adjusts the press position when performing the additional folding operation is described below with reference to FIGS. 29A and 29B. FIGS. 29A and 29B are diagrams illustrating the second example of how the folding unit 3 according to the first embodiment adjusts the press position in the additional folding operation.

FIGS. 29A and 29B illustrate an example in which, as in FIGS. 28A and 28B, the sheet 6 is folded in outward tri-fold with the first crease 6*a* and the second crease 6*b* formed on the leading end and the trailing end, respectively, in the conveying direction of the sheet 6. As in FIGS. 28A and 28B, FIG. 29A differs from FIG. 29B in the distance between the first crease 6*a* and the second crease 6*b*.

The folding unit 3 according to the first embodiment performs the additional folding operation as described below. As illustrated in the left diagram of FIG. 29A, the folding unit 3 presses the first crease 6*a* and the second crease 6*b* as in FIG. 28A.

Meanwhile, the folding unit 3 can change a position where a crease is to be formed depending on a fold type and the size of the sheet 6. Accordingly, the need of changing the press position depending on a position of a crease when performing the additional folding operation arises.

In response to the need, the folding unit 3 according to the first embodiment is configured to, after pressing the first crease 6*a*, conveys the sheet 6 a previous distance, which is the distance between the first crease 6*a* and the second crease 6*b* the positions of which have not been changed yet, and simultaneously shifts the additional folding roller 370 a distance corresponding to a change in distance between the first crease and the second crease as illustrated in FIG. 29B. The example illustrated in FIG. 29B differs from that illustrated in FIG. 29A in that the distance between the first crease 6*a* and the second crease 6*b* is changed from L to L'. Accordingly, after pressing the first crease 6*a*, the folding unit 3 conveys the sheet 6 the distance L and, simultaneously, shifts the additional folding roller 370 the distance L−L'.

As described above, the folding unit 3 according to the first embodiment is configured to adjust the press position in accordance with a position of a crease formed in the sheet 6 by shifting the additional folding roller 370 when performing the additional folding operation. Accordingly, the folding unit 3 according to the first embodiment can press a crease accurately even if the position of the crease varies from one sheet to another.

Meanwhile, when the additional folding roller 370 is shifted, the distance between the additional folding roller 370 and a driver that drives the additional folding roller 370 changes. Accordingly, the folding unit 3 according to the first embodiment is configured to control a drive transmission mechanism such as a timing belt using a tensioner or the like. Hence, in the first embodiment, the driver that drives the additional folding roller 370 functions as a shifting unit.

Figure 30A:
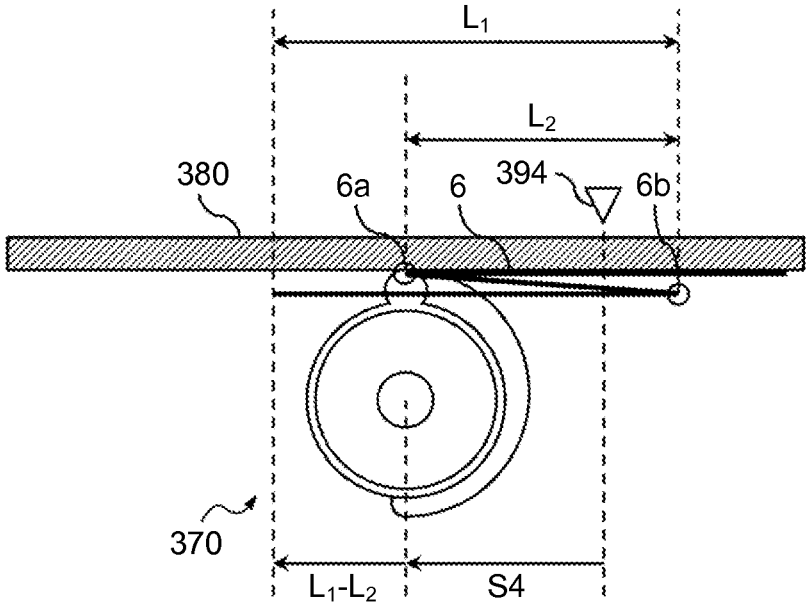
FIGS. 30A and 30B are diagrams illustrating an example of how the folding unit according to the first embodiment adjusts a press position when performing the additional folding operation.
Figure 30B:
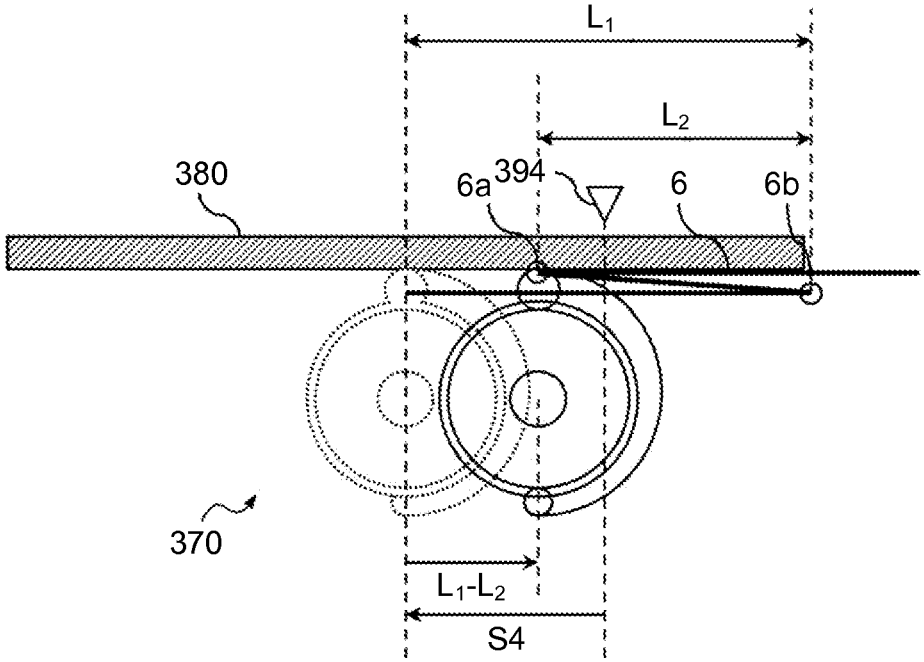

An example of how the folding unit 3 according to the first embodiment adjusts the press position when performing the additional folding operation on the sheet 6 in which a crease is not on the leading end in the conveying direction of the sheet 6 is described below with reference to FIGS. 30A and 30B. FIGS. 30A and 30B are diagrams illustrating the example of how the folding unit 3 according to the first embodiment adjusts the press position when performing the additional folding operation.

When a crease is not on the leading end in the conveying direction of the sheet 6, the folding unit 3 according to the first embodiment cannot detect the first crease 6*a* formed in the sheet 6 using the fourth sheet detection sensor 394.

To solve this problem, the folding unit 3 according to the first embodiment is configured to adjust the press position when performing the additional folding operation on a crease that is not on the leading end in the conveying direction of the sheet 6 by considering the distance S4 with distances $L_1$ and $L_2$ into account. More specifically, upon detection of the leading end in the conveying direction of the sheet 6 by the fourth sheet detection sensor 394, the folding unit 3 conveys the sheet 6 the distance S4+$L_1$−$L_2$, where $L_1$ is the distance between the leading end in the conveying direction of the sheet 6 and the second crease 6*b*, and $L_2$ is the distance between the first crease 6*a* and the second crease 6*b* as illustrated in FIG. 30A.

Alternatively, the folding unit 3 according to the first embodiment may be configured to adjust the press position when performing the additional folding operation on a crease that is not on the leading end in the conveying direction of the sheet 6 by conveying the sheet 6 the distance S4 upon detection of the leading end in the conveying direction of the sheet 6 by the fourth sheet detection sensor 394 and, simultaneously, shifting the additional folding roller 370 the distance $L_1-L_2$ as illustrated in FIG. 30B.

The distance $L_1-L_2$ is the distance calculated from fold information about the fold type and sheet information about the size of the sheet 6 in the conveying direction. Accordingly, the sheet 6 conveyed the conveying distance, which is changed by the distance $L_1-L_2$, is to be situated immediately above the additional folding roller 370. The folding unit 3 presses the first crease 6*a* at this position.

As described above, the folding unit 3 according to the first embodiment is configured to adjust the press position in accordance with a position of a crease formed in the sheet 6 on the basis of the fold information and the sheet information when performing the additional folding operation. Accordingly, the folding unit 3 according to the first embodiment can press a crease accurately even if the crease is not on the leading end of the sheet 6.

Figure 31A:
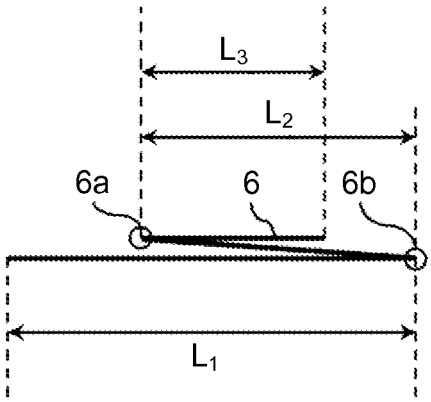
FIGS. 31A and 31B are diagrams each illustrating an example of a folded shape of the sheet on which the additional folding operation is to be performed by the folding unit according to the first embodiment.
Figure 31B:
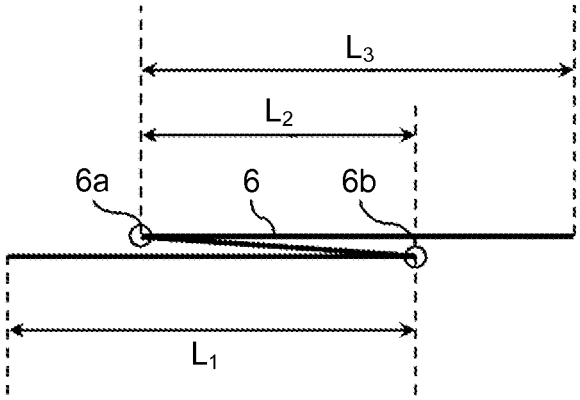

Meanwhile, in the first embodiment, no crease is on the leading end in the conveying direction of the sheet 6 when the following condition is satisfied: the sheet 6 is folded as illustrated in FIG. 31A or 31B in outward tri-fold or z-fold so as to satisfy the following relationship: "total length in the conveying direction of the sheet 6 that is not folded yet">$L_3+L_2\times2$, where $L_3$ is the distance between the first crease 6*a* and the trailing end in the conveying direction of the sheet 6. If $L_1-L_2>0$ holds, no crease is on the leading end in the conveying direction of the sheet 6 irrespective of in which fold type the sheet 6 is folded.

Figure 32A:
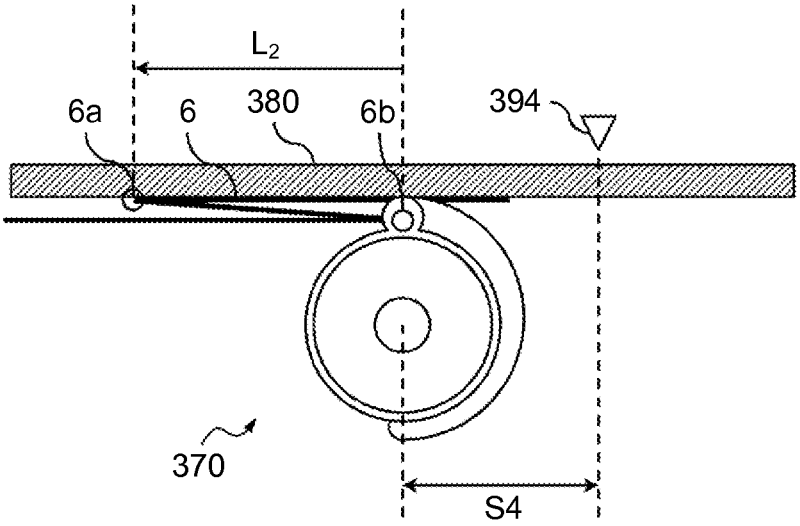
FIGS. 32A and 32B are diagrams illustrating an example of how the folding unit according to the first embodiment adjusts a press position when performing the additional folding operation.
Figure 32B:
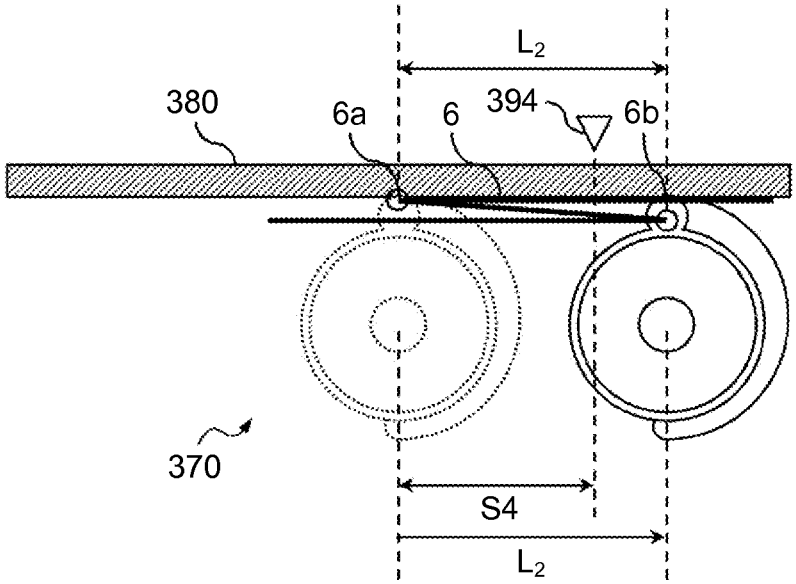

An example of how the folding unit 3 according to the first embodiment adjusts the press position when performing the additional folding operation on the sheet 6 where no crease is formed on the trailing end in the conveying direction of the sheet 6 is described below with reference to FIGS. 32A and 32B. FIGS. 32A and 32B are diagrams illustrating the example of how the folding unit 3 according to the first embodiment adjusts the press position when performing the additional folding operation.

When a crease is not on the trailing end in the conveying direction of the sheet 6, the folding unit 3 according to the first embodiment cannot detect the second crease 6*b* formed in the sheet 6 using the fourth sheet detection sensor 394.

To solve this problem, the folding unit 3 according to the first embodiment is configured to adjust the press position when performing the additional folding operation on a crease that is not on the trailing end in the conveying direction of the sheet 6 by conveying the sheet 6 only the distance $L_2$ after pressing the first crease 6*a* as illustrated in FIG. 32A.

Alternatively, the folding unit 3 according to the first embodiment may be configured to adjust the press position when performing the additional folding operation on a crease that is not on the trailing end in the conveying direction of the sheet 6 by shifting the additional folding roller 370 only the distance $L_2$ after pressing the first crease 6*a* as illustrated in FIG. 32B.

The distance $L_2$ is the distance between the first crease 6*a* and the second crease 6*b* and calculated from the fold information about the fold type and the sheet information about the size of the sheet 6 in the conveying direction. Accordingly, when the sheet 6 has been conveyed the predetermined distance $L_2$, the second crease 6*b* is to be situated immediately above the additional folding roller 370. The folding unit 3 presses the second crease 6*b* at this position.

As described above, the folding unit 3 according to the first embodiment is configured to adjust the press position in accordance with a position of a crease formed in the sheet 6 on the basis of the fold information and the sheet information when performing the additional folding operation. Accordingly, the folding unit 3 according to the first embodiment can press a crease accurately even if the crease is not on the trailing end of the sheet 6.

Figure 33A:
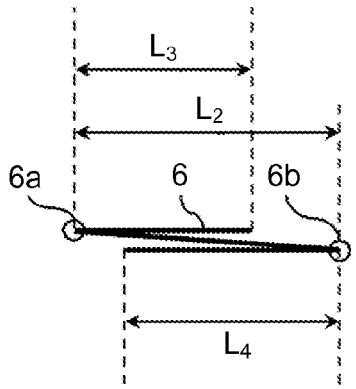
FIGS. 33A to 33C are diagrams each illustrating an example of a folded shape of the sheet on which the additional folding operation is to be performed by the folding unit according to the first embodiment.
Figure 33B:
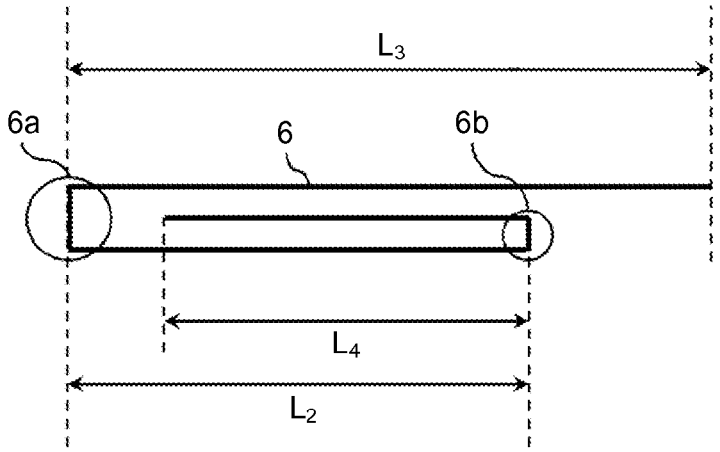
Figure 33C:
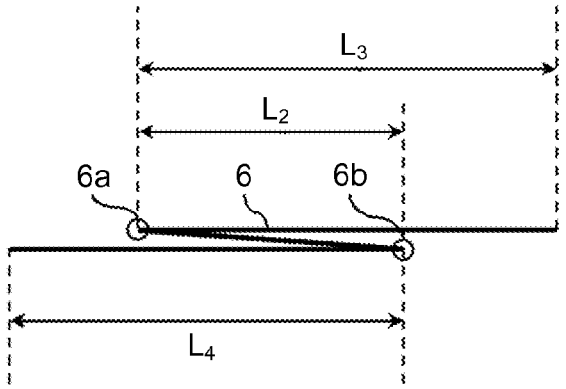

Meanwhile, in the first embodiment, no crease is on the trailing end in the conveying direction of the sheet 6 when the following condition is satisfied: the sheet 6 is folded as illustrated in FIG. 33A or 33B in outward tri-fold or inward tri-fold so as to satisfy the following relationship: "total length in the conveying direction of the sheet 6 that is not folded yet">$L_4+L_2\times2$, where $L_4$ is the distance between the first crease 6*a* and the leading end in the conveying direction of the sheet 6. If the sheet 6 is folded in z-fold, no crease is on the trailing end in the conveying direction of the sheet 6 as illustrated in FIG. 33C. This is because when the sheet 6 is folded in z-fold, the following relationship holds without exception: "total length in the conveying direction of the sheet 6 that is not folded yet">$L_4+L_2\times2$. If $L_3-L_2>0$ holds, no crease is on the trailing end in the conveying direction of the sheet 6 irrespective of in which fold type the sheet 6 is folded.

As described above, the folding unit 3 according to the first embodiment is configured to adjust the press position in accordance with a position of a crease formed in the sheet 6 by adjusting the conveying distance of the sheet 6 or by shifting the additional folding roller 370 when performing the additional folding operation. Accordingly, the folding unit 3 according to the first embodiment can press a crease accurately even if the position of the crease varies from one sheet to another.

Furthermore, the folding unit 3 according to the first embodiment is configured to adjust the press position in accordance with a position of a crease formed in the sheet 6 on the basis of the fold information and the sheet information when performing the additional folding operation. Accordingly, the folding unit 3 according to the first embodiment can press a crease accurately even if the crease is not on the leading end or the trailing end in the conveying direction of the sheet 6.

In the first embodiment, the main control module 101 determines S1, S2, and S3, each being an conveyance amount of the sheet 6, depending on setting values including a fold type, a fold position(s), and the size of a sheet to be folded by the folding unit 3. In the first embodiment, the main control module 101 determines a conveyance amount for conveying the sheet 6 to the press position where the sheet 6 is to be pressed by the additional folding roller 370 and a shift amount of the additional folding roller 370 on the basis of the setting values.

The conveyance amount is the conveyance distance or conveyance time of the sheet 6, or a drive amount such as a pulse count, drive time, or a drive distance of a conveyance driver that drives the conveying unit that conveys the sheet 6. The shift amount is the shift distance or shift time of the additional folding roller 370, or a drive amount such as a pulse count, drive time, or a drive distance of a shift driver that shifts the additional folding roller 370.

In the first embodiment, an example in which the image forming apparatus 1 includes the image forming unit 2, the folding unit 3, the finisher unit 4, and the scanner unit 5 has been described. Alternatively, a configuration in which the units are independent devices, and the devices are connected to each other to make up an image forming system may be employed.

In the first embodiment, an example where creases, namely, the first crease 6*a* and the second crease 6*b*, are formed at the two positions in the sheet 6 has been described below. However, aspects of the invention may also be applied to a sheet where creases are formed at three or more positions.

Second Embodiment

In the additional folding roller 370 according to the first embodiment, as described above with reference to FIGS. 17 to 20 and FIGS. 21 to 24, the rib-like pressing-force transmission part 372 is arranged on the circumferential surface of the pressing-force transmission roller 373 in the helical shape extending along the main-scanning direction and having the fixed angle difference θ with respect to the additional folding-roller rotation shaft 371.

Accordingly, the additional folding roller 370 according to the first embodiment can rotate about the additional folding-roller rotation shaft 371, thereby pressing a crease formed in the sheet 6 gradually in one direction along the main-scanning direction.

Hence, the folding unit 3 according to the first embodiment can apply a focused pressing force throughout the crease in a short period of time. For this reason, the folding unit 3 according to the first embodiment can apply the sufficient pressing force to the crease while reducing a load placed on the additional folding-roller rotation shaft 371 without lowering productivity.

The folding unit 3 according to a second embodiment of is configured as in the first embodiment and, furthermore, configured to apply a sufficient pressing force to a crease by rotating the additional folding roller 370 at a low speed when performing the additional folding operation but, when not performing the additional folding operation, increase productivity by rotating the additional folding roller 370 at a high speed. The second embodiment is described more specifically below. Like numerals refer to identical or equivalent elements between the first and second embodiments, and repeated description is simplified or omitted.

A first method by which the folding unit 3 according to the second embodiment applies a sufficient pressing force to a crease while increasing productivity is described below with reference to FIGS. 34A to 34D. FIGS. 34A to 34D are diagrams illustrating an example of how the folding unit 3 according to the second embodiment operates to apply a sufficient pressing force to a crease while increasing productivity.

Figure 34A:
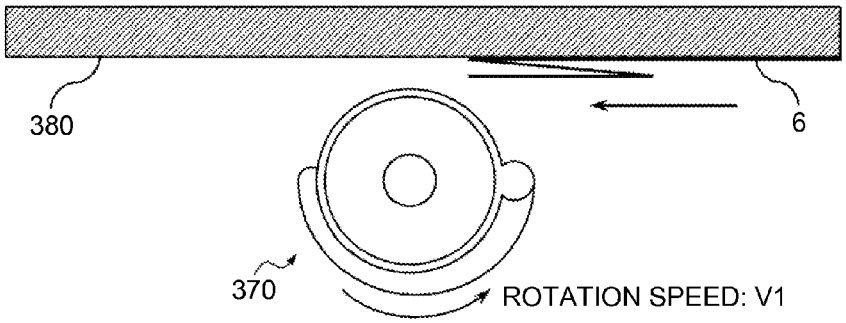
FIGS. 34A to 34D are diagrams illustrating an example of how a folding unit according to a second embodiment of the present invention operates to apply a sufficient pressing force to a crease while increasing productivity.
Figure 34B:
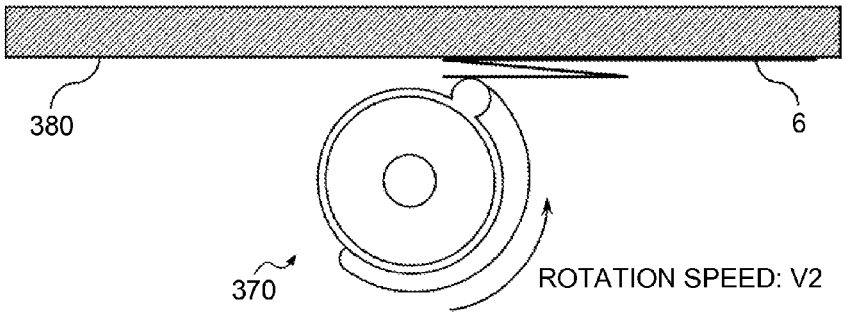
Figure 34C:
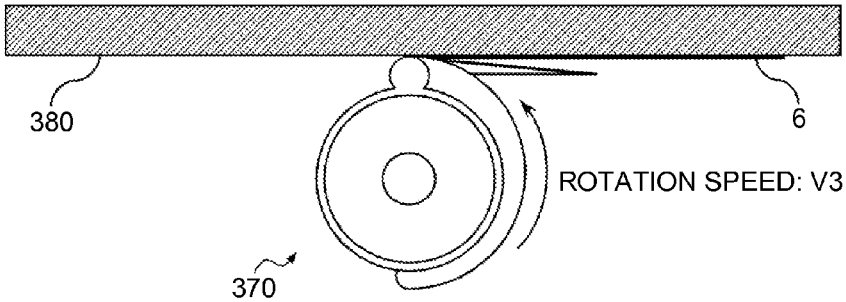
Figure 34D:
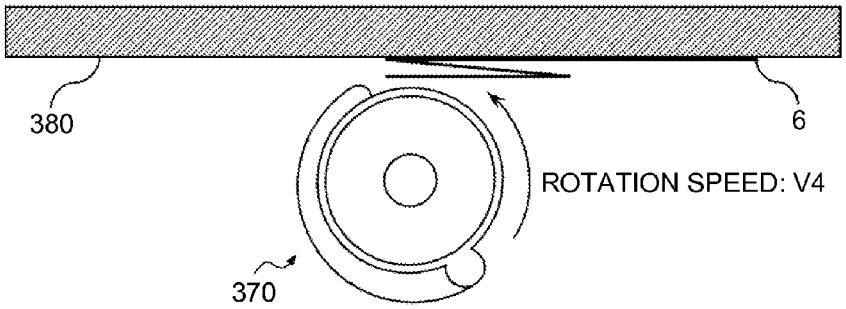

The folding unit 3 according to the second embodiment applies a sufficient pressing force to a crease while increasing productivity by controlling the rotation speed of the additional folding roller 370 so as to satisfy: V2<V1, V2<V3, and V2<V4, where V1 is the rotation speed of the additional folding roller 370 between when the additional folding roller 370 leaves its home position and when the additional folding roller 370 contacts the sheet 6 as illustrated in FIG. 34A, V2 is the rotation speed of the additional folding roller 370 at an instant when the additional folding roller 370 contacts the sheet 6 as illustrated in FIG. 34B, V3 is the rotation speed of the additional folding roller 370 that is pressing the sheet 6 as illustrated in FIG. 34C, V4 is the rotation speed of the additional folding roller 370 between when the additional folding roller 370 comes out of contact with the sheet 6 and when the additional folding roller 370 returns to its home position as illustrated in FIG. 34D.

As described above, the folding unit 3 according to the second embodiment can apply a sufficient pressing force to a crease by causing the additional folding roller 370 to rotate at a low speed (V3) when the additional folding roller 370 is pressing the sheet 6. The folding unit 3 according to the second embodiment can also reduce sliding noise between the additional folding roller 370 and the sheet 6 by causing the additional folding roller 370 to rotate at the low speed (V3) when the additional folding roller 370 is pressing the sheet 6.

Furthermore, the folding unit 3 according to the second embodiment can increase productivity by causing the additional folding roller 370 to rotate at a high speed (V1=V4) when the additional folding roller 370 is not in contact with the sheet 6.

The folding unit 3 according to the second embodiment can also reduce noise made by collision between the additional folding roller 370 and the sheet support plate 380 by causing the additional folding roller 370 to rotate at a still lower speed (V2) at an instant when the additional folding roller 370 contacts the sheet 6.

As described above, the folding unit 3 according to the second embodiment can achieve four effects, which are additional folding effect, reduction in sliding noise, increasing productivity, and reduction in collision noise, by changing the rotation speed of the additional folding roller 370 depending on a status so as to satisfy V2<V3<V1=V4.

More specifically, the folding unit 3 according to the second embodiment controls the rotation speed of the additional folding roller 370 such that the rotation speed is at its lowest, V2, at an instant when the additional folding roller 370 contacts the sheet 6 to reduce the collision noise between the additional folding roller 370 and the sheet support plate 380. The folding unit 3 according to the second embodiment controls the rotation speed of the additional folding roller 370 so that the rotation speed is at its highest, V1 and V4, when the additional folding roller 370 is neither at an instant when contacting the sheet 6 nor pressing the sheet 6.

Figure 35A:
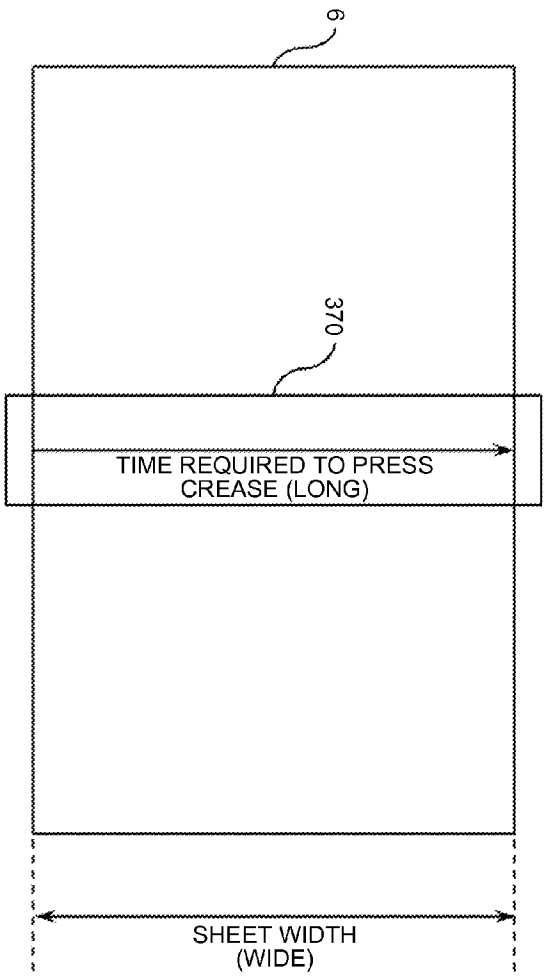
FIGS. 35A and 35B are diagrams each illustrating an example of a sheet on which the additional folding operation is to be performed by the folding unit according to the second embodiment.
Figure 35B:
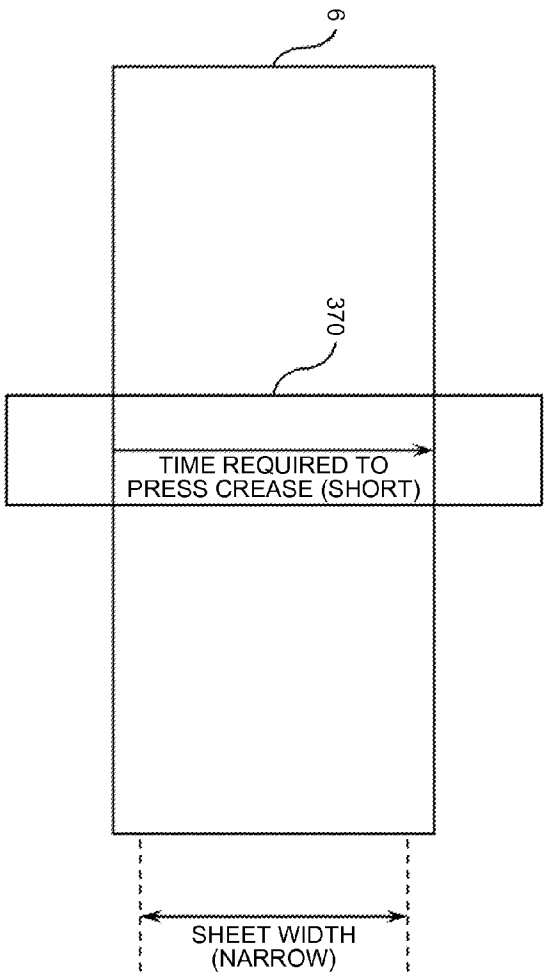

Meanwhile, time required to press a crease in a sheet varies depending on the width of the sheet such that the narrower the sheet width, the shorter the time required to press the crease as illustrated in FIGS. 35A and 35B. Taking this into consideration, the folding unit 3 according to the second embodiment calculates time required to press a crease from the sheet width and the rotation speed of the additional folding roller 370, and changes the rotation speed of the additional folding roller 370 from V3 to V4 immediately when pressing the crease is completed.

As described above, the folding unit 3 according to the second embodiment is configured to change timing for changing the rotation speed of the additional folding roller 370 from V3 to V4 depending on the sheet width. This configuration allows the folding unit 3 according to the second embodiment to further increase productivity.

Figure 36A:
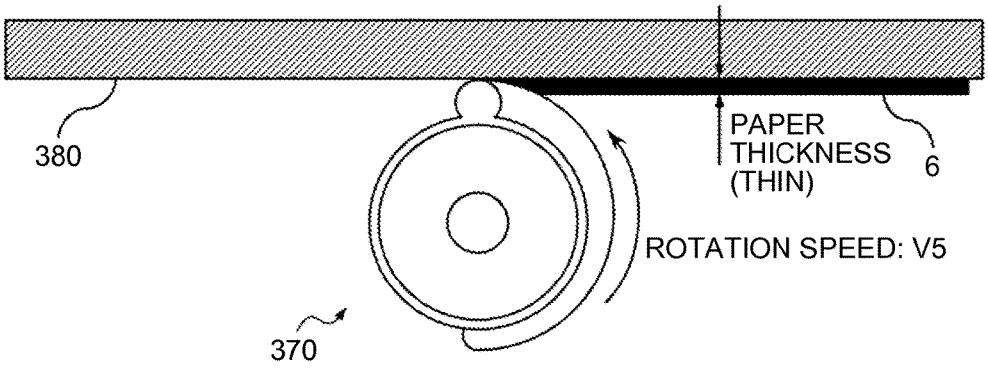
FIGS. 36A and 36B are diagrams illustrating an example of how the folding unit according to the second embodiment operates to apply a sufficient pressing force to a crease while increasing productivity.
Figure 36B:
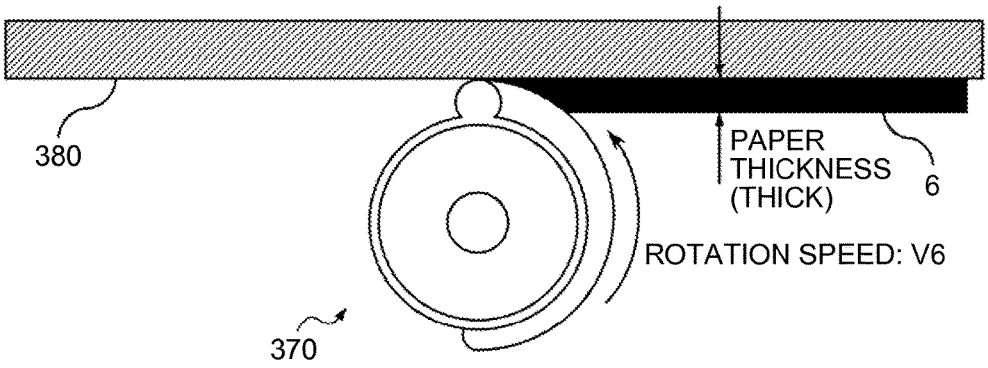

The second method by which the folding unit 3 according to the second embodiment applies a sufficient pressing force to a crease while increasing productivity is described below with reference to FIGS. 36A to 36D. FIGS. 36A and 36B are diagrams illustrating an example of how the folding unit 3 according to the second embodiment operates to apply a sufficient pressing force to a crease while increasing productivity.

The folding unit 3 according to the second embodiment applies a sufficient pressing force to a crease while increasing productivity by controlling the rotation speed of the additional folding roller 370 so as to satisfy: V6<V5, where V5 is the rotation speed of the additional folding roller 370 pressing the sheet 6 that is thin as illustrated in FIG. 36A, V6 is the rotation speed of the additional folding roller 370 pressing the sheet 6 that is thick as illustrated in FIG. 36B.

As described above, the folding unit 3 according to the second embodiment can increase productivity by causing the additional folding roller 370 to rotate at a high speed (V5) when the additional folding roller 370 is pressing the sheet 6 that is thin. The reason therefor is that the thinner the paper, the more easily a crease in the paper can be sharpened.

The folding unit 3 according to the second embodiment can apply a sufficient pressing force to a crease by causing the additional folding roller 370 to rotate at a low speed (V6) when the additional folding roller 370 is pressing the sheet 6 that is thick. The reason therefor is that the thicker the paper, the less easily a crease in the paper can be sharpened.

As described above, the folding unit 3 according to the second embodiment can achieve both additional folding and increasing productivity by changing the rotation speed of the additional folding roller 370 depending on paper thickness so as to satisfy V6<V5.

Meanwhile, as the number of times a sheet is to be folded by the folding unit 3 according to the second embodiment increases, the height of the folded sheet increases due to an increase in the number of layers. Accordingly, by changing the rotation speed of the additional folding roller 370 depending on the number of folds in a manner similar to the operations illustrated in FIGS. 36A and 36B, both additional folding effect and increasing productivity can be achieved more effectively.

As described above, the folding unit 3 according to the second embodiment can apply a sufficient pressing force to a crease by rotating the additional folding roller 370 at a low speed when performing the additional folding operation while, when not performing the additional folding operation, increasing productivity by rotating the additional folding roller 370 at a high speed.

According to the present invention, user convenience at causing a crease formed in a sheet to be pressed can be increased.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A sheet processing device comprising:

a folding unit configured to fold a sheet to form two or more creases in the sheet;

a conveyer configured to convey the sheet;

a presser downstream of the folding unit and configured to press the two or more creases in the sheet;

a sheet detector arranged on a downstream side of the folding unit and on an upstream side of the presser in a conveying direction of the sheet, and configured to detect a leading edge of the sheet; and a setting unit configured to set press positions for creases, wherein the two or more creases formed in the sheet include a first crease formed to align with one edge of the sheet in the conveying direction, after the sheet detector detects the one edge of the sheet, the conveyer is configured to convey the sheet by a predetermined distance to a position where the first crease faces the presser, and the presser is configured to press the first crease in the conveyed sheet.

2. The sheet processing device of claim 1, wherein in response to the first crease being formed on an end in the conveying direction of the sheet, the conveyer is configured to convey, upon detection of the end in the conveying direction, the sheet a distance between the sheet detector and the presser.

3. The sheet processing device of claim 1, wherein in response to a crease being formed at a plurality of positions of the sheet and none of the creases is on an end of the sheet in the conveying direction, the conveyer is configured to convey, upon detection of the end in the conveying direction, the sheet a distance obtained by adding a distance between the sheet detector and the presser to a distance between the crease in the sheet and the end in the conveying direction.

4. The sheet processing device of claim 1, wherein the two or more creases includes a second crease formed upstream of the first crease in the conveying direction, and the conveyer is configured to convey, after the presser presses the first crease, the sheet by a distance X, the distance X being a distance between the first crease and the second crease.

5. The sheet processing device of claim 1, wherein the presser is configured to rotate about an axis lying in a direction parallel to the crease so as to press the crease gradually in the direction parallel to the crease.

6. An image forming system comprising:

an image forming apparatus configured to form an image on a sheet; and the sheet processing device according to claim 1, the sheet processing device being configured to press a crease in the sheet on which the image is formed by the image forming apparatus.

7. The sheet processing device of claim 1, wherein the conveyer is configured to convey the sheet a distance, to the position where another crease faces the presser, the distance being variable based upon at least one of a fold type and a size of the conveyed sheet.

8. The sheet processing device of claim 1, wherein the conveyer configured to convey the sheet at a relatively lower speed when the presser is pressing the sheet and is configured to convey the sheet a relatively higher speed when the presser is not pressing the sheet.

9. The sheet processing device of claim 1, further comprising:

an end detector configured to detect an end in a conveying direction of the sheet at a position upstream of the presser in the conveying direction, wherein upon detection of the end in the conveying direction, the conveyer is configured to convey the sheet a distance, to the position where another crease faces the presser.

10. The sheet processing device of claim 1, wherein the two or more creases further includes a second crease formed to align with another edge of the sheet in the conveying direction, and after the sheet detector detects the another edge of the sheet, the conveyer is configured to convey the sheet by a predetermined distance so that the presser presses the second crease.

11. The sheet processing device according to claim 1, wherein the sheet further includes a second crease formed therein, and a distance between the one edge of the sheet in the conveying direction and the second crease is larger than a distance between the first crease and another edge of the sheet.

12. The sheet processing device according to claim 1, wherein the presser is independent of the folding unit.

13. The sheet processing device according to claim 1, wherein the presser further includes a plate member facing the presser.

14. A sheet processing device comprising:

a conveyer configured to convey a sheet having a crease formed therein;

a presser configured to press the crease in the sheet;

an end detector configured to detect an end in a conveying direction of the sheet at a position upstream of the presser in the conveying direction;

a setting unit configured to set a crease position where the crease is to be formed, wherein upon detection of the end in the conveying direction, the conveyer is configured to convey the sheet to a position where the crease faces the presser, on the basis of the crease position set by the setting unit, and the presser is configured to press the crease in the conveyed sheet; and a shifting unit configured to shift the presser in the conveying direction of the sheet, wherein the shifting unit is configured to shift the presser to a position where the presser faces the crease, on the basis of the crease position set by the setting unit and a conveyance amount of the sheet conveyed by the conveyer, the conveyer being configured to convey, upon detection of the end in the conveying direction, the sheet to the position where the crease faces the presser, on the basis of the crease position set by the setting unit and a shift amount of the presser shifted by the shifting unit, and the presser being configured to press the crease in the conveyed sheet at a position to which the presser is shifted.

15. An image forming system comprising:

an image forming apparatus configured to form an image on a sheet; and the sheet processing device according to claim 14, the sheet processing device being configured to press a crease in the sheet on which the image is formed by the image forming apparatus.

16. The sheet processing device of claim 14, wherein the conveyer is configured to convey the sheet a distance, to the position where another crease faces the presser, the distance being variable based upon at least one of a fold type and a size of the conveyed sheet.

17. The sheet processing device of claim 14, wherein the conveyer configured to convey the sheet at a relatively lower speed when the presser is pressing the sheet and is configured to convey the sheet a relatively higher speed when the presser is not pressing the sheet.

18. A sheet processing device comprising:

a conveyer configured to convey a sheet;

a presser, configured to press a crease in the sheet, a support plate to support a pressing roller and the sheet;

an end detector configured to detect an end of the sheet in a conveying direction, at a position upstream of the presser in the conveying direction; and a setting unit configured to set a crease position where the crease is to be formed in the sheet, wherein the conveyer is configured to convey the sheet to a position where the crease faces the presser, on the basis of the crease position set by the setting unit, the presser is configured to press the crease in the sheet upon the sheet being conveyed to a position where the crease faces the presser, and in response to creases being formed at a plurality of positions of the sheet and none of the creases being formed on a trailing end in the conveying direction of the sheet, and when a second crease, subsequent to a first crease closest to a leading end in the conveying direction of the sheet among the creases formed at the plurality of positions, is to be pressed, the conveyer is configured to convey, upon detection of the leading end in the conveying direction, the sheet a distance obtained by adding a distance between the second crease and the leading end in the conveying direction to a distance between the end detector and the presser to thereby convey the sheet to a position where the crease faces the presser.

19. An image forming system comprising:

an image forming apparatus configured to form an image on a sheet; and the sheet processing device according to claim 18, the sheet processing device being configured to press a crease in the sheet on which the image is formed by the image forming apparatus.

* * * * *